US009913770B2

(12) United States Patent
Lachenbruch et al.

(10) Patent No.: US 9,913,770 B2
(45) Date of Patent: Mar. 13, 2018

(54) CLIMATE MANAGEMENT TOPPER WITH SHAPE CHANGE ACTUATORS FOR REGULATING COOLANT DISTRIBUTION

(71) Applicant: Hill-Rom Services, Inc., Batesville, IN (US)

(72) Inventors: Charles A. Lachenbruch, Batesville, IN (US); David L. Ribble, Indianapolis, IN (US); Sandy M. Richards, Pershing, IN (US); Laetitia Gazagnes, Montpellier (FR)

(73) Assignee: Hill-Rom Services, Inc., Batesville, IN (US)

( * ) Notice: Subject to any disclaimer, the term of this patent is extended or adjusted under 35 U.S.C. 154(b) by 337 days.

(21) Appl. No.: 14/623,852

(22) Filed: Feb. 17, 2015

(65) Prior Publication Data

US 2016/0235210 A1 Aug. 18, 2016

(51) Int. Cl.

| | |
|---|---|
| ***A61G 7/05*** | (2006.01) |
| ***A61G 7/057*** | (2006.01) |
| ***A47C 21/04*** | (2006.01) |
| ***A47C 27/00*** | (2006.01) |

(52) U.S. Cl.

CPC ..... *A61G 7/05* (2013.01); *A47C 21/044* (2013.01); *A47C 27/00* (2013.01); *A61G 7/05784* (2016.11)

(58) Field of Classification Search

CPC .... A61G 7/05; A61G 7/05784; A47C 21/044; A47C 27/00

See application file for complete search history.

(56) References Cited

U.S. PATENT DOCUMENTS

| | | | | |
|---|---|---|---|---|
| 8,327,477 | B2 * | 12/2012 | Lachenbruch | A61F 7/02 5/421 |
| 8,656,919 | B2 | 2/2014 | Bhat et al. | |
| 8,876,579 | B2 | 11/2014 | Browne et al. | |
| 2003/0109908 | A1 * | 6/2003 | Lachenbruch | A47C 21/046 607/96 |
| 2007/0135878 | A1 * | 6/2007 | Lachenbruch | A61G 7/057 607/108 |
| 2007/0261548 | A1 * | 11/2007 | Vrzalik | A47C 21/044 95/52 |
| 2010/0122417 | A1 * | 5/2010 | Vrzalik | A47C 21/046 5/652.1 |

(Continued)

*Primary Examiner* — Nicholas F Polito
*Assistant Examiner* — Rahib T Zaman
(74) *Attorney, Agent, or Firm* — Kenneth C. Baran

(57) ABSTRACT

One embodiment of a climate management topper includes a flowpath boundary which defines a flowpath adapted to carry a stream of fluid in a principal direction. A flow compliant filler occupies at least part of the flowpath. The filler includes a spacer and a set of shape change actuators (SCA's) each of which is made of a shape change material (SCM). The properties of the SCM include a critical temperature T0. The SCA's are configured to regulate distribution of the fluid stream through the flowpath in a direction transverse to the principal direction as a function of temperature. In one example the flowpath boundary is formed by liner panels and the SCA's are linear elements that elongate at a temperature TH which is higher than T0 thereby distending the spacer and reducing its resistance to fluid flow. One suitable shape change material is a nickel/titanium alloy known as NiTiNOL.

35 Claims, 27 Drawing Sheets

(56) References Cited

U.S. PATENT DOCUMENTS

2010/0274331 A1* 10/2010 Williamson ..... A61G 7/05738 607/104
2011/0068939 A1* 3/2011 Lachenbruch ..... A61B 5/002 340/626
2011/0283459 A1* 11/2011 Essers ..... A47C 27/005 5/699
2012/0012277 A1* 1/2012 Lachenbruch ..... A47C 21/044 165/60
2012/0060295 A1* 3/2012 Flick ..... A61G 7/015 5/655.5
2012/0284918 A1* 11/2012 Gazagnes ..... A61G 7/05769 5/421
2013/0025053 A1* 1/2013 Vrzalik ..... A61G 7/057 5/495
2013/0172802 A1* 7/2013 Cavanaugh ..... A61G 7/057 602/46
2013/0189920 A1* 7/2013 Vrzalik ..... A47C 21/044 454/338
2013/0205506 A1* 8/2013 Lachenbruch ..... A47C 21/042 5/691
2013/0212808 A1* 8/2013 Lachenbruch ..... A47C 27/05 5/691
2013/0298330 A1* 11/2013 Lachenbruch ..... A61G 7/05784 5/606
2014/0109314 A1* 4/2014 Boersma ..... A47C 21/044 5/423
2014/0196210 A1* 7/2014 Lachenbruch ..... A61G 7/001 5/423
2014/0196216 A1* 7/2014 Weitzel ..... A61G 7/057 5/691
2014/0250604 A1* 9/2014 Lanning ..... A61G 7/057 5/726
2014/0366277 A1* 12/2014 Niederkrom ..... A61G 7/057 5/691

* cited by examiner

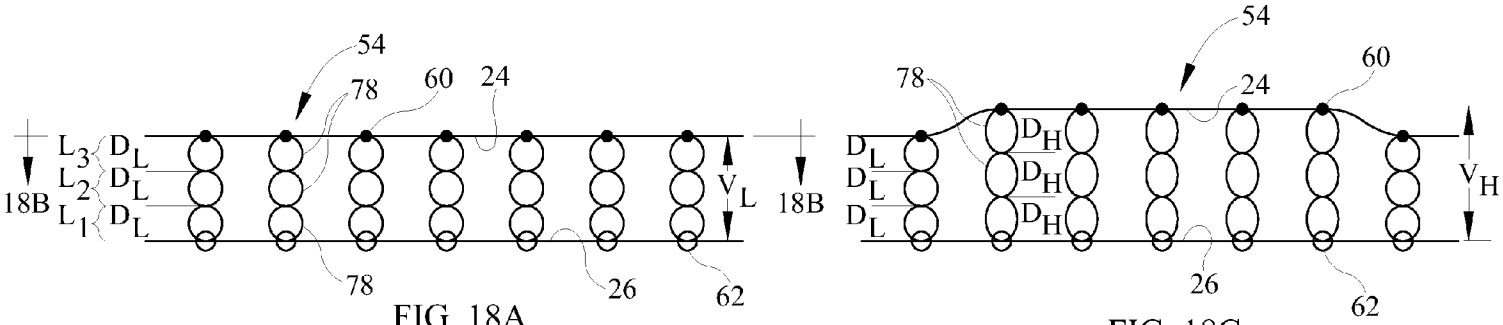
FIG. 18A
FIG. 18C
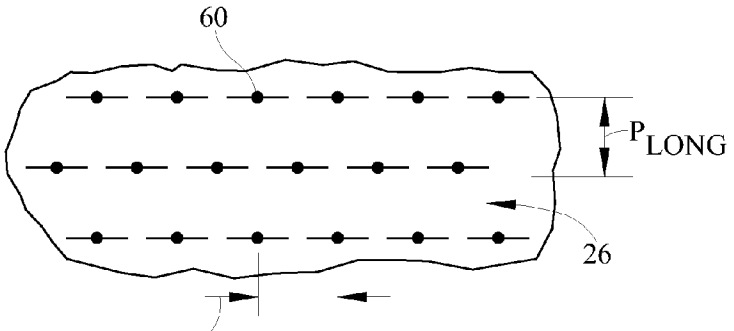
FIG. 18B
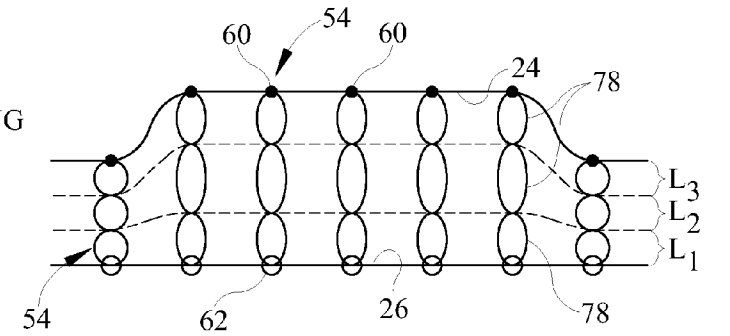
FIG. 18D
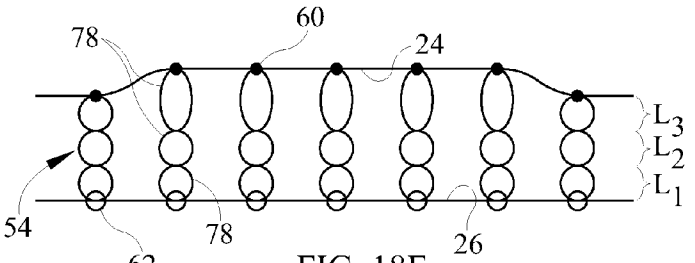
FIG. 18E
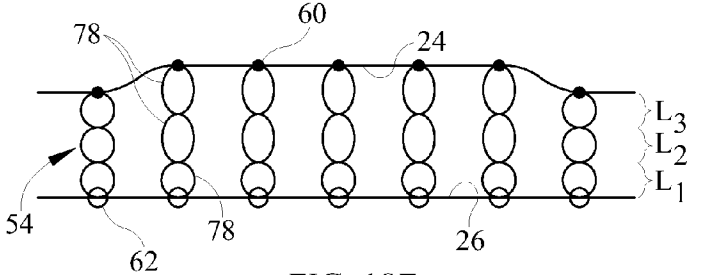
FIG. 18F

CLIMATE MANAGEMENT TOPPER WITH SHAPE CHANGE ACTUATORS FOR REGULATING COOLANT DISTRIBUTION

TECHNICAL FIELD

The subject matter described herein relates to the use of shape changing materials to regulate the distribution of fluid flow in a conduit. One example conduit is a climate control topper for a bed.

BACKGROUND

Beds used in hospitals, other health care facilities and home health care settings may be equipped with a climate management topper which manages the temperature and humidity in the immediate vicinity of a bed occupant. The topper may be integrated with a mattress or may be a separate component placed atop the mattress. A typical topper includes a liner which has a lower panel facing away from the occupant and an upper panel facing toward the occupant. In some cases the upper panel is liquid permeable. The liner panels define an interpanel interior space. The topper also includes a gas inlet for admitting gaseous fluid into the interior space and a gas outlet for exhausting the gaseous fluid from the interior space. A blower is connected to the topper inlet by a gas supply conduit. A spacer material occupies the interior space. The spacer is fibrous or mesh-like and therefore porous enough to permit gas flow through the topper interior space from the gas inlet to the gas outlet. During operation the blower propels a stream of coolant, usually ambient air, through the interior space from the inlet to outlet. Accordingly the interior space serves as a fluid flowpath. The fluid stream helps cool the skin of the bed occupant and carry away any occupant perspiration or other liquid which migrates across the liquid permeable upper panel. Both the cooling and the liquid transport are desirable to help resist the formation of pressure ulcers on the occupant's skin. The portions of an occupant's anatomy that bear heavily on the topper are the sites most susceptible to the development of pressure ulcers. Assuming the occupant is supine, these sites may include the occupant's shoulder blades, buttocks, elbows and heels. Therefore these are sites where targeted, preferential climate control would be most beneficial for resisting the formation of pressure ulcers.

The spacer exhibits some degree of crush resistance but nevertheless becomes compressed and therefore denser where it bears the weight of the occupant. This increased density locally increases resistance to airflow and therefore causes diversion of some of the coolant air to other portions of the flowpath where the occupant's weight is not bearing as heavily on the topper. As a result less coolant flows under the heavily loaded parts of the occupant's body, which are the portions most susceptible to pressure ulcers, while more coolant flows underneath the portions of the occupant's body that are more lightly loaded and therefore less susceptible to pressure ulcers. This is opposite what is needed.

One way to achieve better targeted climate management is described in US 2013/0212808 (application Ser. No. 13/401,401) which describes a flowpath shaped to preferentially direct coolant to where it is predicted to be most needed. Yet another way to achieve better targeted climate management is described in US 2013/0205506 (application Ser. No. 13/396,224) which describes a flowpath with non-uniform resistance to preferentially drive coolant to where it is predicted to be most needed. These systems offer simplicity, but are "one size fits all" solutions that cannot readily accommodate patient specific needs such as directing coolant to account for the exact position of the patient on the topper and to account for which portions of the occupant's anatomy are most needful of climate management at any given time. Another way to focus the coolant on the most susceptible sites is described in U.S. Pat. No. 8,327,477 which describes a system in which a controller activates selected thermally conductive pathways in response to information from a detector, such as an array of pressure sensors. Although this system can provide patient specific targeted cooling and can respond to changing requirements, it requires certain components that are not ordinarily used with conventional climate management toppers (e.g. the thermally conductive pathways, the pressure sensors, and a set of thermoelectric modules) as well as software to control system operation.

It is, therefore, desirable to provide a climate management system that is occupant specific (e.g. responsive to the occupant's position and responsive to which portions of the occupant's body are most susceptible to pressure ulcer formation at any given time). It is also desirable for such a system to be passive, i.e. to not require a controller.

SUMMARY

A topper, such as those used with beds in patient care environments includes a flowpath boundary which defines a flowpath adapted to carry a stream of fluid in a principal direction. A flow compliant filler occupies at least part of the flowpath. The filler is comprised of a spacer and a set of shape change actuators (SCA's) comprised of a shape change material (SCM) whose properties include a critical temperature T0. The SCA's are configured to regulate distribution of the fluid stream through the flowpath as a function of temperature.

BRIEF DESCRIPTION OF THE DRAWINGS

The foregoing and other features of the various embodiments of the topper and climate management system described herein will become more apparent from the following detailed description and the accompanying drawings in which:

FIGS. 18A, 18B and 18C are views similar to those of FIGS. 10A, 10B and 10C respectively in which the SCA's are chains formed of vertically stacked ringlets.

FIG. 18D is a view similar to that of FIG. 18C in which the chain is comprised of ringlets that do not have the same shape change response.

FIGS. 18E and 18F are views similar to that of FIG. 18C in which the chain is comprised of ringlets having different critical temperatures.

DETAILED DESCRIPTION

Figure 1:
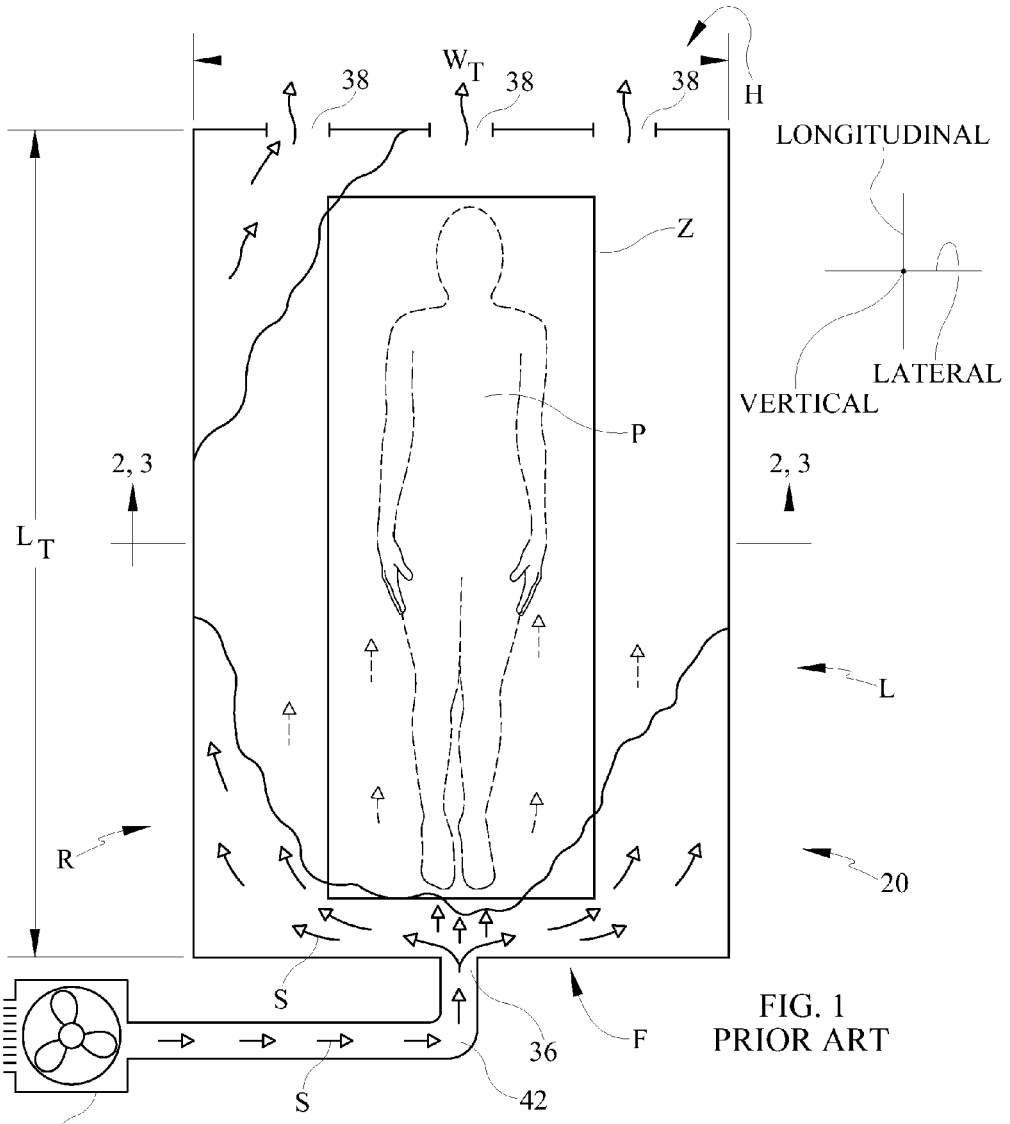
FIG. 1 PRIOR ART
FIG. 1 is a plan view of a conventional topper, a portion of which is broken away to show fluid flow in the interior of the topper, and also showing a supine patient or occupant and a zone Z where the occupant is most likely to be located.
Figure 2:
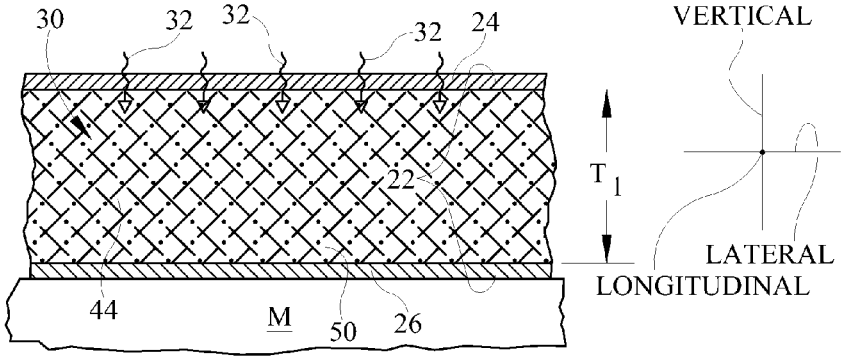
FIG. 2 PRIOR ART
FIG. 2 is an cross sectional view of the topper of FIG. 1 taken in the direction 2-2 of FIG. 1 without the weight of the patient and also showing a portion of a mattress.

Referring to FIGS. 1-3, a conventional climate management topper 20 extends longitudinally from a head end H to a foot end F and laterally from a left side L to a right side R where "left" and "right" are taken from the vantage point of a supine occupant or patient P. FIGS. 1-2 also includes a set of axes to show the longitudinal, lateral and vertical directions. The topper has a length $L_T$ and a width $W_T$. The topper includes a liner 22 comprised of upper and lower liner panels 24, 26 which define an interpanel interior space 30. In some toppers upper panel 24 is liquid permeable so that liquids such as perspiration can migrate through the liner and into the interior space as indicated by arrows 32 in FIG. 2. A gas inlet 36 and a gas outlet 38 penetrate through the liner at the foot and head ends respectively. A blower 40 is connected to the topper inlet by an air supply conduit 42. During operation the blower propels a stream of coolant S, usually ambient air, through the interior space from inlet 36 to outlet 38. Accordingly the interior space serves as a fluid flowpath 44 whose boundary is defined by liner 22. The fluid stream helps cool the skin of the occupant and carry away any occupant perspiration or other liquid which migrates across the liquid permeable upper panel. Both the cooling and the liquid transport are desirable to help resist the formation of pressure ulcers on the occupant's skin. The topper may be permanently integrated with a mattress M or may be a separate component which can be placed atop the mattress or removed from the mattress as necessary.

Figure 3B:
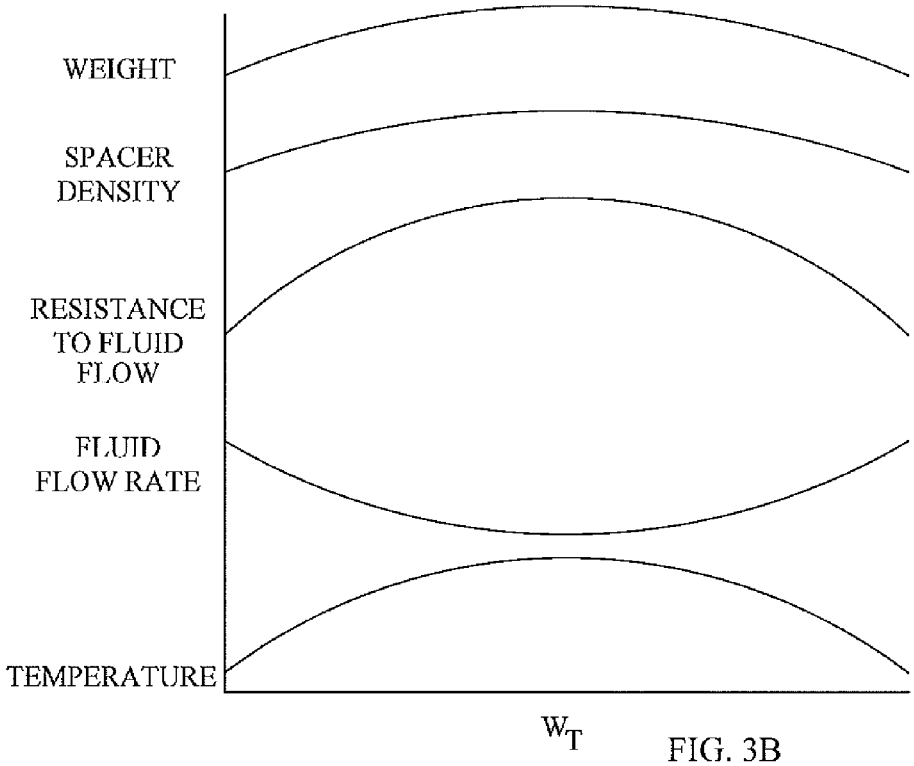
FIG. 3B PRIOR ART
FIG. 3 is a view similar to that of FIG. 2 with the weight of the patient bearing on the topper.

A spacer material 50 occupies the interior space and is illustrated schematically by dash-dot crosshatch lines. The spacer material is fibrous or mesh-like or otherwise constructed to be porous enough to permit air to flow through the topper interior space from inlet 36 to outlet 38. Accordingly the spacer material is referred to as "flow compliant". The spacer material exhibits some degree of crush resistance but nevertheless becomes compressed where it bears the weight of the occupant so that its local thickness may decrease from, for example, T1 to as little as T2 as seen by comparing FIG. 3A to FIG. 2. However even when compressed the spacer material retains enough porosity to permit gas flow through the interior space and underneath the occupant. This is shown by the graphs of FIG. 3B showing applied weight W, spacer density, resistance to fluid (gas) flow, fluid (gas) mass flow rate, and temperature. The density graph shows that the density of the spacer material is greatest where the largest amount of weight is imposed by a portion of the occupant's body, and smaller where less weight is imposed. Density of the spacer material means the quantity of spacer material occupying a given volume of space, as distinct from the intrinsic mass per unit volume of a representative sample of the spacer material itself. For example FIG. 4A shows a quantity of spacer material having an intrinsic density of 6.45 gm./cc packed into a volume of 64 cubic centimeters. FIG. 4B shows that same quantity of material packed into a volume of 27 cubic centimeters. The intrinsic density of the material is 6.45 gm./cc in both cases, however the density of interest in the present application is 2.4 times as great in FIG. 4B as in FIG. 4A (64/27=2.4).

Figure 3A:
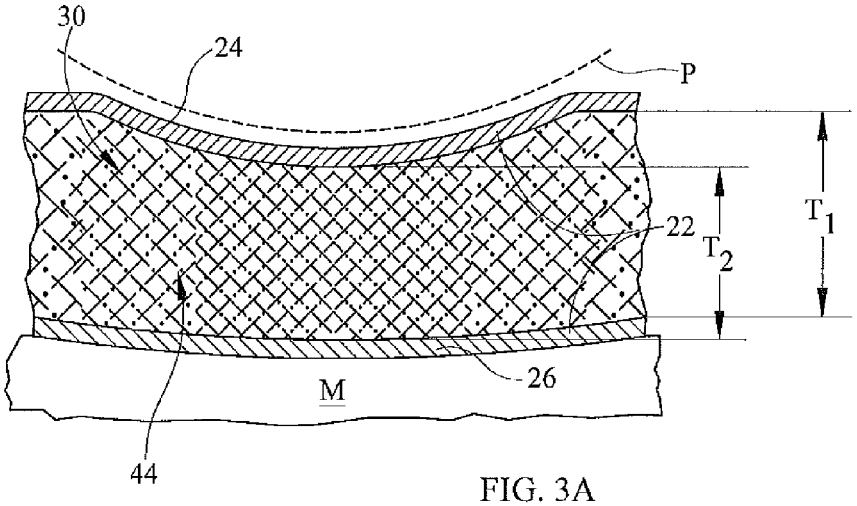
FIG. 3A PRIOR ART
Figure 4A:
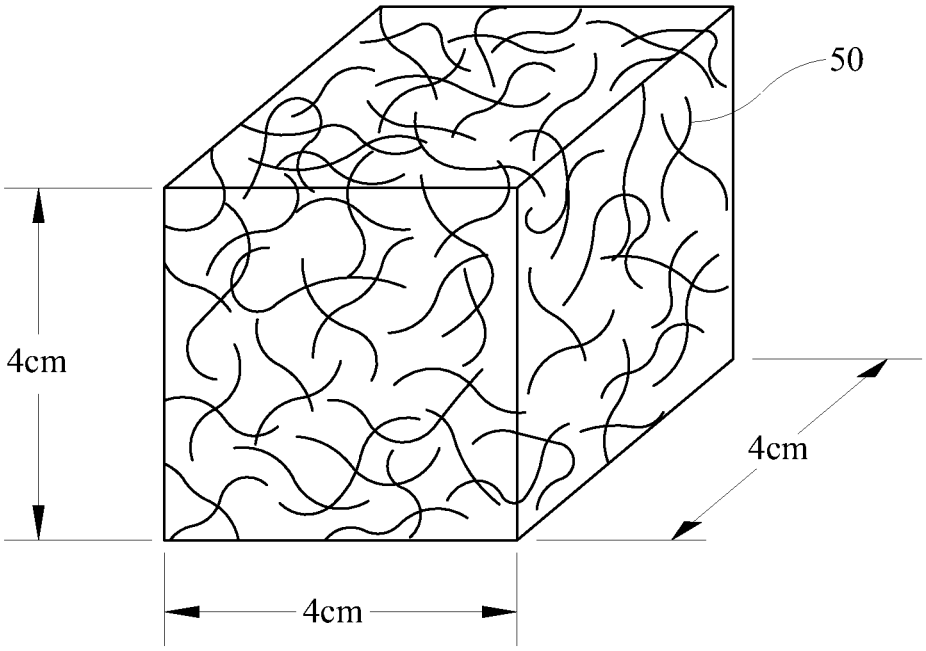
FIG. 4 is an illustration demonstrating the meaning of "density" as used in this application in connection with a filler in the interior of the topper.
Figure 4B:
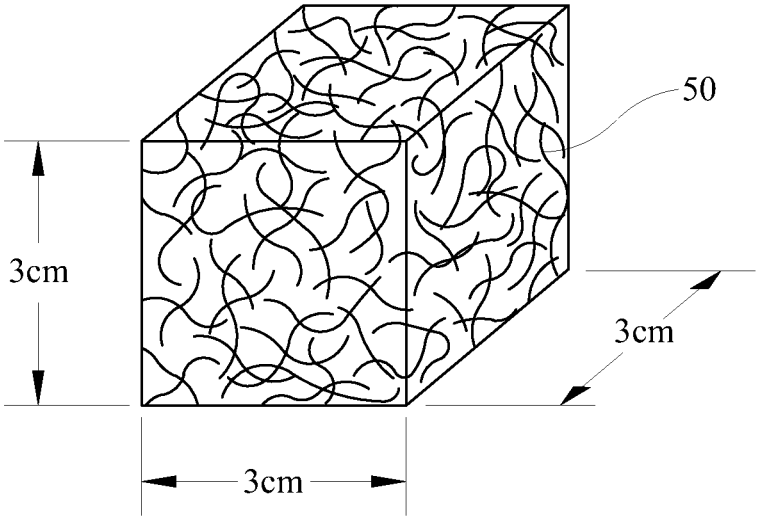

Continuing to refer to FIGS. 3A and 3B, the resistance to gas flow is greatest where the spacer material density is greatest because the spacer material is more compacted or compressed. As a result the gas flow rate across the plane of the illustration (e.g. in mass per unit time) is smallest where the density of the spacer material is greatest. This is suggested in FIG. 3A by the nonuniform density of the dash-dot crosshatch lines representing the spacer material, and in FIG. 1 by the way the gas stream (represented by arrows S) diverges laterally away from gas inlet 36 and exhibits a propensity to flow around rather than underneath the occupant. The final graph of FIG. 3B shows temperature at or near the occupant's skin. The temperature is highest where the occupant's weight bears most heavily on the topper because of the relatively lower mass flow rate of coolant (the airstream S) underneath the occupant. The higher temperature, in combination with the higher pressure on the occupant's tissue, makes the tissue in that vicinity more susceptible to pressure ulcers. As noted previously it would be desirable to mitigate the local decrease of coolant mass flow rate arising from the occupant's weight bearing on the topper, and to do so in a way that self-compensates for changes in the occupant's weight distribution on the topper.

Figure 5:
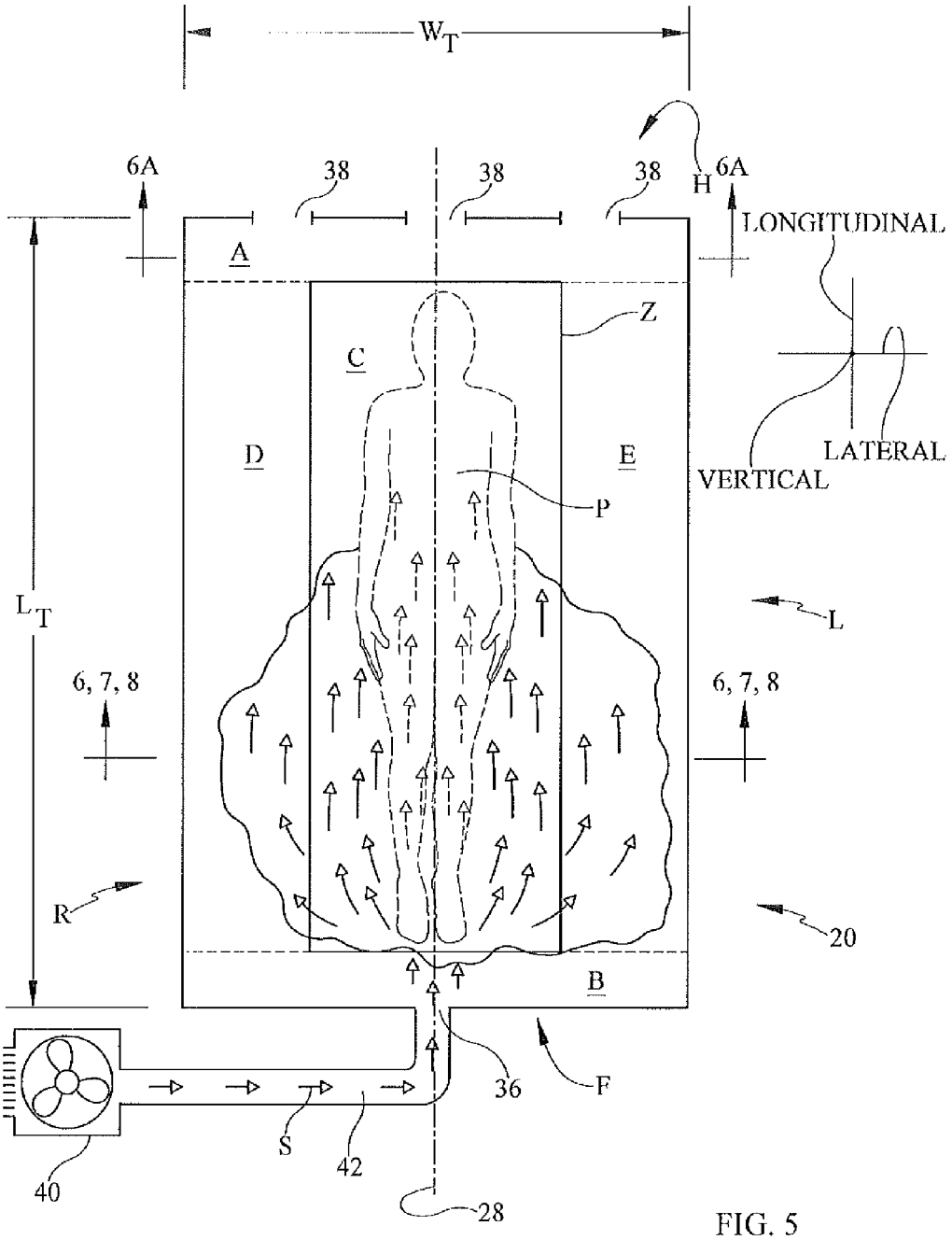
FIG. 5 is a plan view of an embodiment of an inventive topper with a portion of the topper broken away to show fluid flow in the interior of the topper, and also showing a supine patient or occupant and a zone Z where the occupant is most likely to be located.

FIGS. 5, 6, 7 and 8 illustrate an embodiment of the inventive climate management topper. Features similar to or the same as features already described in connection with the conventional topper are identified by the same reference numerals already used. The topper 20 extends longitudinally from a head end H to a foot end F and laterally from a left side L to a right side R where "left" and "right" are taken from the vantage point of the supine occupant or patient P. FIGS. 4-5 also includes a set of axes to show the longitudinal, lateral and vertical directions and a centerplane 28. The topper has a length $L_T$ and a width $W_T$. The topper includes a liner 22 comprised of upper and lower liner panels 24, 26 which define an interior volume or interior space 30. In some toppers upper panel 24 is liquid permeable so that liquids such as perspiration can migrate through the liner and into the interior space as indicated by arrows 32 in FIG. 2. A gas inlet 36 penetrates through the liner at the foot end of the topper. A gas outlet 38, shown as a series of exhaust ports, penetrates through the liner at the head end of the topper. A blower 40 is connected to the topper inlet by an air supply conduit 42.

During operation the blower propels a stream of coolant S, usually ambient air, through the interior space from inlet 36 to outlet 38. Accordingly the interior space serves as a fluid flowpath 44 whose boundary is defined by liner 22. The flowpath is adapted to carry a stream of fluid (the ambient air/coolant) in a principal direction. The principal direction is defined as the overall direction of fluid flow through the topper. For example FIGS. 1 and 5 both show a lateral directional component to fluid stream S particularly where it spills out of inlet 36 and spreads out inside interior space 30 and where it converges toward outlet 38. However the overall direction in which the fluid stream flows is the longitudinal direction from inlet 36 at the foot end of the topper to outlet 38 at the head end. Hence, the principal direction in FIGS. 1 and 5 is the longitudinal direction. The fluid stream helps cool the skin of the occupant and carry away any occupant perspiration or other liquid which migrates across the liquid permeable upper panel in order to help resist the formation of pressure ulcers on the occupant's skin. The topper may be permanently integrated with a mattress M or may be a separate component which can be placed atop the mattress or removed from the mattress as necessary.

A flow compliant filler 52 occupies the interior space. The filler is comprised of flow compliant spacer material 50 occupying at least part of flowpath 44 and a compensation system comprised of one or more compensators 54 (also referred to as actuators or shape change actuators and abbreviated herein as SCA's). Letter suffixes (A, B, etc.) are applied to reference numeral 54 when necessary to distinguish between or among the actuators in the same illustration. Each actuator is comprised of a shape change material (SCM). Shape change materials include the various shape memory materials (SMM's) such as shape memory alloys (SMA's) shape memory polymers (SMP's) shape memory composites (SMC's) and shape memory hybrids (SMH's). The properties of relevant SCM's include a critical temperature T0, such that when the SCM is at some temperature TL, which is lower than T0, the SCA made from the SCM has a predictable, stable, repeatable baseline shape, and when the SCM is at a temperature TH, which is greater than T0, the SCA takes on a predictable, stable, repeatable non-baseline shape different from the baseline shape. The literature directed to shape memory alloys teaches that the shape memory properties arise from two stable phases, a lower temperature martensitic phase and a higher temperature austenitic phase. The state or phase transformation (e.g. from austenitic to martensitic) does not begin exactly at T0 but begins at a temperature lower than T0 (which temperature is usually denoted $M^{0s}$ in the metallurgical literature) and continues to evolve until an even lower temperature ($M^{0f}$) is reached. The literature also teaches that the state transformation (e.g. from martensitic to austenitic) also does not begin exactly at T0 but begins at a temperature higher than T0 (usually denoted $A^{0s}$ in the metallurgical literature) and continues to evolve until an even higher temperature ($A^{0f}$) is reached. In the interest of simplicity this application will refer to the temperatures on either side of the critical temperature as TL (lower than T0) and TH (higher than T0), and it should be understood that TL and TH refer to the temperature at which the transformation has progressed sufficiently to achieve a shape change sufficient for the intended purposes described herein. References herein to the SCM or SCA being "at" a particular temperature means that the SCM or SCA exhibits the state or shape associated with that temperature. Which of the two states is designated as the baseline state is a matter of descriptive preference and therefore either state can be designated as the baseline state. In this application the lower temperature state (at TL) is taken to be the baseline state.

In the case of shape memory alloys such as NiTiNOL, the predictable shapes exhibited at temperatures above and below T0 are attributable to transition between the martensitic and austenitic solid state phases, however a material that exhibits different predictable, "memorized", repeatable, stable shapes at temperatures above and below some known temperature T0 are suitable even if the shapes result from a physical mechanism other than a phase change. It should also be noted that shapes qualify as baseline and non-baseline even though they may bear a geometric resemblance to each other. For example an actuator which is in the form of a short, squat cylinder in its baseline state and in the form of a tall, slender cylinder in its non-baseline state is considered to have undergone a shape change even though both shapes are cylinders. It should also be appreciated that the phrase "critical temperature" is used in this application in the way it is used in the metallurgical literature directed to shape memory alloys, i.e. to refer to a temperature below which an object takes on one predictable, stable, repeatable state and above which the object takes on some other predictable, stable, repeatable state. "Critical" is not a concession that a element must appear in a patent claim in order for the claim to be definite as explained at section 2164.08(c) of the Manual of Patent Examining Procedure (Ninth Edition, March 2014).

Figure 6:
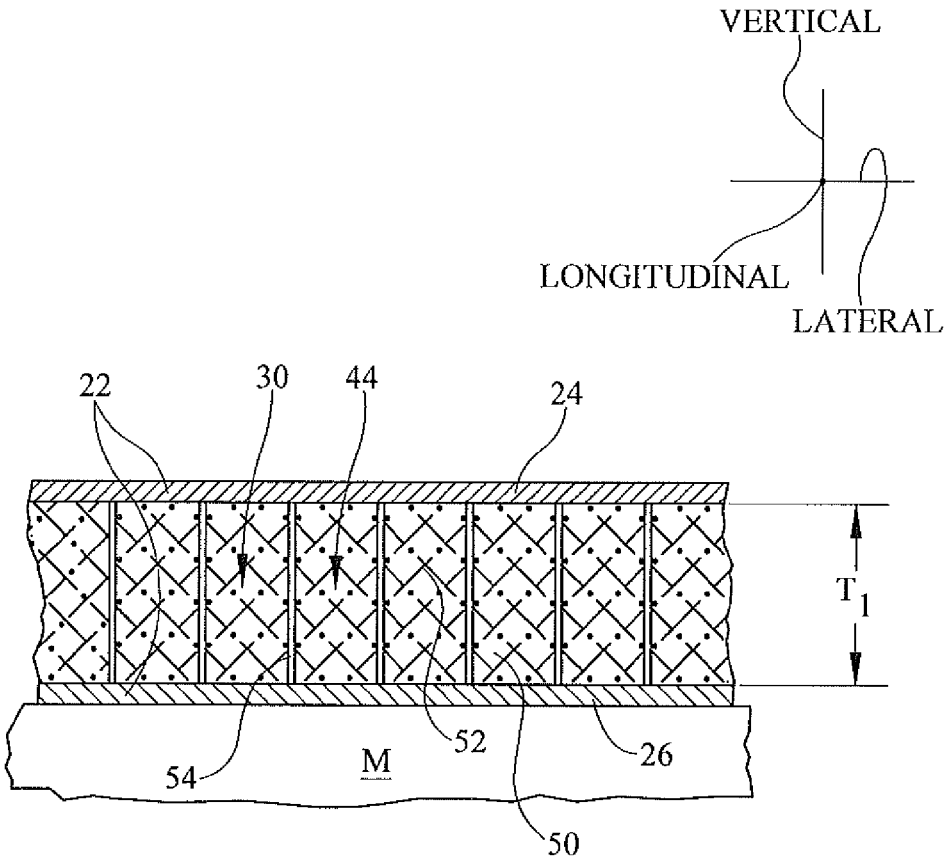
FIG. 6 is a view in direction 6-6 of FIG. 5 showing a spacer comprised of a filler material and a set of shape change actuators but without the weight of an occupant bearing on the topper.
Figure 7:
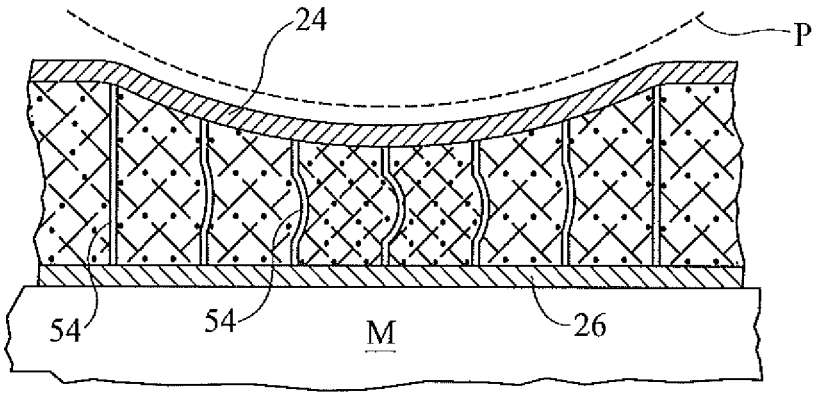
FIG. 7 is a view in direction 7-7 of FIG. 5, and similar to that of FIG. 6 but with the weight of the occupant bearing on the topper and prior to response of the actuators.
Figure 8:
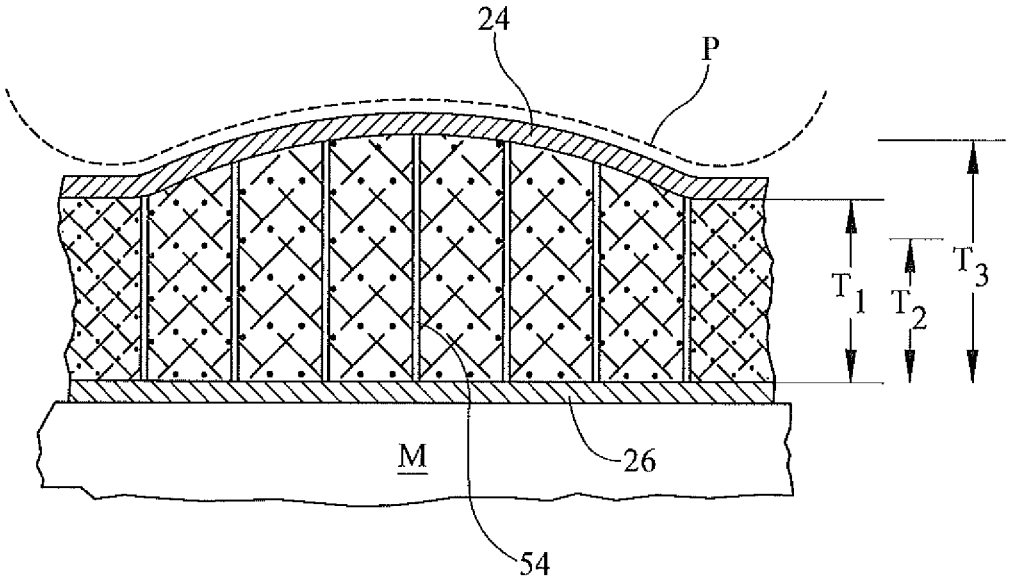
FIG. 8 is a view in direction 8-8 of FIG. 5, and similar to that of FIGS. 6 and 7 but with the weight of the occupant bearing on the topper and subsequent to response of the actuators.

In general, the shape change actuators are configured to regulate distribution of the fluid stream through the flowpath as a function of temperature. In the embodiment of FIGS. 5-8 the actuators are configured to distribute the fluid stream in a direction transverse to the principal direction so that the mass flow rate of the fluid is nonuniform in the transverse direction. FIG. 6 shows a variant in which the shape change actuators (SCA's) are linear elements 54 oriented vertically and which extend between liner panels 24 and 26. In FIG. 6 there is no occupant weight bearing on the topper. The elements 54 are at a temperature TL, below the critical temperature T0 of the material of which they are made. As a result the actuators are in their baseline state or shape. The filler 52 has a thickness T1, just as in the conventional topper of FIG. 2. In FIG. 7 the weight of a body part of the occupant P bears on the topper. In response to application of the weight, spacer material 50 becomes compressed (essentially as in FIG. 2 but with actuators 54 deforming (e.g. buckling) to accommodate the compression). The reduction of filler thickness from T1 to T2 and the accompanying increase in filler density (as seen in FIG. 7) causes a reduction of coolant flow rate underneath those parts of the patient's body where the patient's weight bears most heavily on the topper. In addition, the fact that the occupant's body part is pressed against the topper traps heat locally and causes an attendant rise in the local temperature. As a result, the local temperature at or in the vicinity of the patient's tissue may increase (as seen in the temperature graph of FIG. 3) from below T0 to a temperature above T0. In the interest of simplicity the explanations throughout this description are written as if the temperature of the SMA's equals the temperature at or in the vicinity of the occupant's skin. In practice the designer will account as necessary for any heat transfer which renders these temperatures unequal by a meaningful amount. If the temperature reaches TH the actuators will take on their non-baseline shape. As seen in FIG. 8, the actuators transition from their deformed shape to a linear shape in which they are more elongated and slender than in the baseline shape of FIG. 6. As a result the actuators counteract the compression of filler material by spreading liner panels 24, 26 vertically away from each other. This may also be thought of as the actuators compensating or overcompensating for the compression. If the spacer material 50 is attached to both panels 24, 26 the spreading of the panels distends and therefore decompresses the spacer material in the vicinity of the actuators that have undergone the shape change. This can be referred to as an direct effect of the actuators on the density of the spacer. If instead the spacer material is attached to only one panel or to neither panel, the spreading of the panels nevertheless causes a local increase in the volume of the interior space so that the spacer material can expand to fill that volume, either because of its own elasticity or because of the influence of the pressurized fluid stream S flowing through the spacer material. This can be referred to as an indirect effect of the actuators on the density of the spacer. Either way the local spacer density and resistance to fluid flow are decreased in the vicinity of the actuators that have undergone the shape change relative to the density and resistance that would otherwise occur (e.g. as seen in the graphs of FIG. 3). As a result the local fluid flow rate (i.e. mass per unit time) is increased relative to the flow rate that would otherwise occur, also as seen in the example of FIG. 3. As noted above the configuration of the SCA's distributes the fluid stream in a direction transverse to the principal direction of fluid flow so that the mass flow rate of the fluid is nonuniform in the transverse direction. In FIGS. 7 and 8 the principal direction is the longitudinal direction and the transverse direction is the lateral direction. In other embodiments the principal direction is a direction other than the longitudinal direction.

Figure 9:
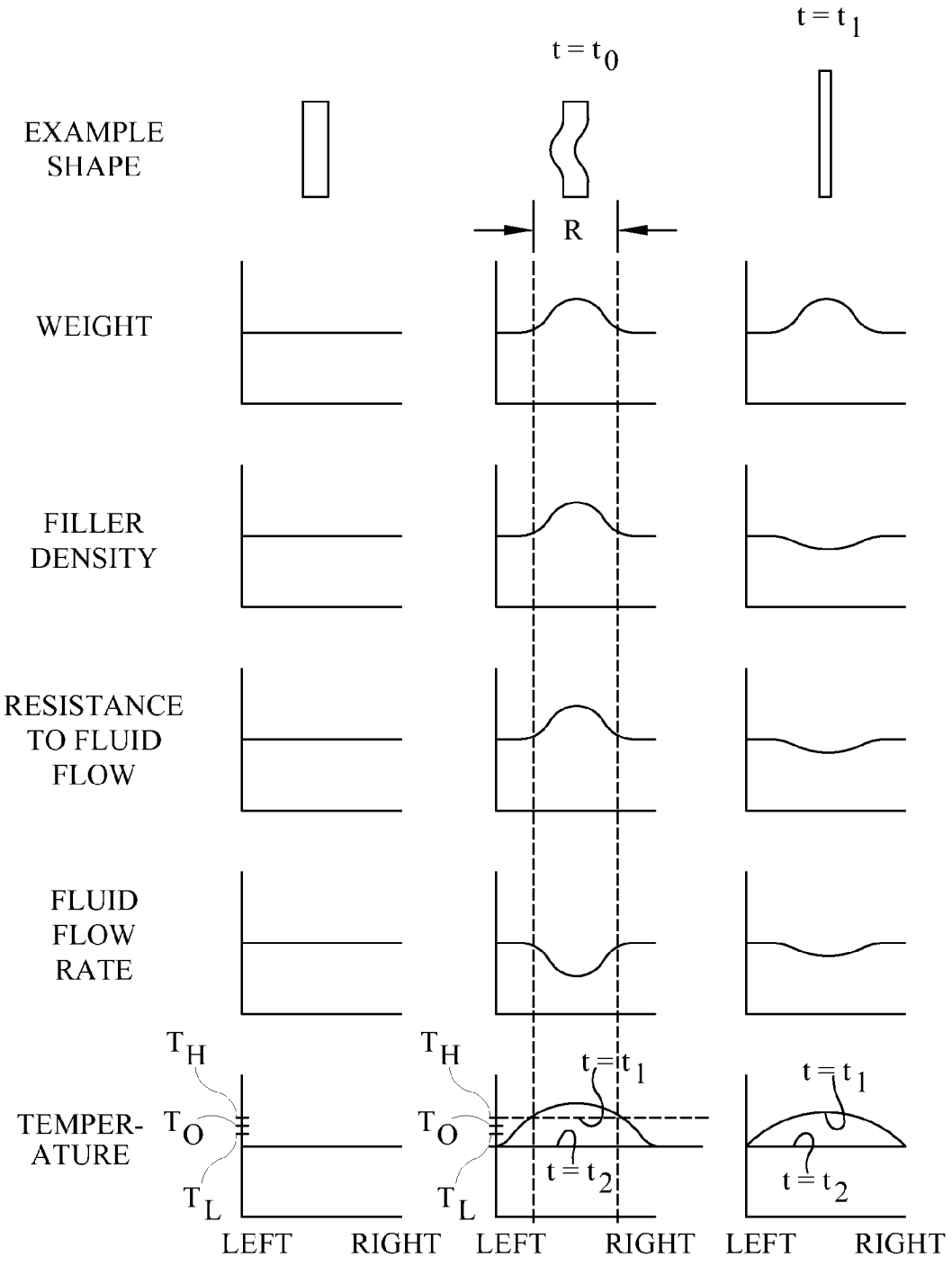
FIG. 9 is a set of graphs schematically showing the variation of selected parameters in the lateral direction for FIGS. 6, 7 and 8.

The foregoing is summarized in the schematic graphs of FIG. 9. which show the profile, in the lateral (transverse) direction, of applied weight, filler density, resistance to fluid (coolant) flow, fluid (coolant) flow rate, and temperature in the vicinity of the SCA's and to which the SCA's respond. The left column corresponds to FIG. 6 (no applied weight and temperature below T0 such that the SCA's assume their baseline shape). The left column shows a laterally uniform distribution of the parameters. The middle column corresponds to FIG. 7 (weight applied) and shows that the application of weight increases the filler density and its resistance to coolant flow at a time $t=t_0$ thereby decreasing the flow rate under the portions of the occupant responsible for the local weight increase. The temperature graph shows that as a result of the locally diminished coolant flow the local temperature increases from below T0 at the time of weight application (time $t=t_0$) to TH at a later time $t=t_1$ in region R. The right column corresponds to FIG. 8 and shows that once temperature increases to TH the accompanying shape change of the SCA distends the filler material or otherwise decreases the local resistance to fluid flow which, in turn, increases the local coolant flow rate. As a result the temperature decreases and, if it decreases to TL (e.g. at $t=t_2$) the SCA's revert to their baseline shape of FIG. 6 or their deformed state of FIG. 7. The cycle may then repeat itself.

Returning now to FIG. 5 in which the principal direction is longitudinal, the topper includes a head segment A, a foot segment B, and a medial segment C longitudinally between and bordered by the head and foot segments. The medial segment comprises a section or zone Z, and left and right flank sections D, E which border zone Z. Zone Z is a laterally interior section or zone between sections D and E and is the zone where the occupant is most likely to be located.

In one embodiment of the topper the filler, which comprises the spacer and the SCA's, occupies at least part of the width of the medial segment, and in particular occupies zone Z and flank sections D and E. In another embodiment the filler occupies only the at least part of the medial segment, in particular zone Z.

Figure 6A:
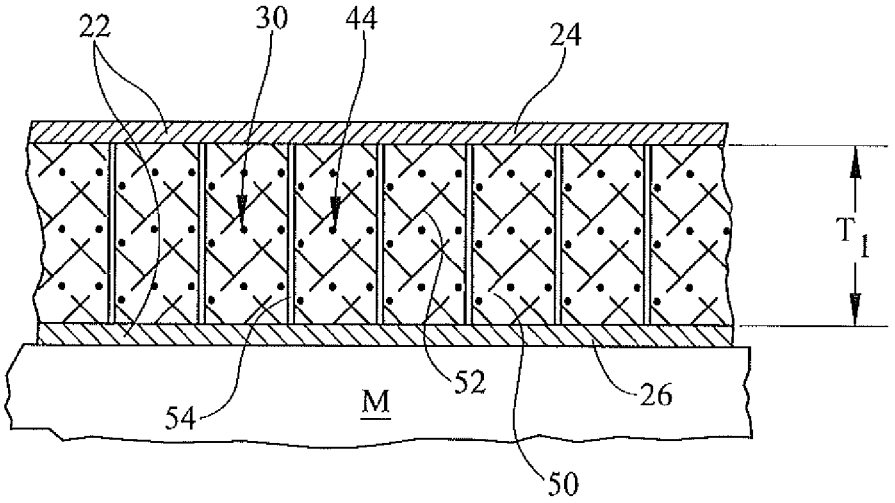
FIG. 6A is a view in direction 6A-6A of FIG. 5 showing a spacer comprised of a filler material and a set of shape change actuators but without the weight of an occupant bearing on the topper, the density of the spacer being less than the density of the spacer of FIG. 6.

In one embodiment of a topper the spacer component of the filler is a first spacer having a first operational density and a first fluid flow resistance. The term "first operational density" means the density of the first spacer material when 1) air is flowing through the flowpath and 2) the actuators have responded in order to decrease the filler density (e.g. as in the rightmost column of FIG. 9). The cross section of FIG. 6 shows a spacer component which has a first operation density and a first fluid flow resistance. The term "first fluid flow resistance" means the fluid flow resistance corresponding to the first operational density. The first spacer may be present only in zone Z or may be present in zone Z and flank sections D and E. A second spacer occupies at least one of the head and foot segments. The second spacer exhibits a second operational density which is less than the first operational density and a second fluid flow resistance which is less than the first fluid flow resistance. The cross section of FIG. 6A shows a spacer component which has a second operational density which is less than the first operation density and a second fluid flow resistance which is less than the first fluid flow resistance. The term "second operational density" means the density of the second spacer material when air is flowing through the flowpath and with occupant weight bearing on the topper. The term "second fluid flow resistance" means the fluid flow resistance corresponding to the second operational density. In such an arrangement the head and/or foot segments are occupied by spacer material (specifically second spacer material), but because its density is lower than that of the first spacer, the second spacer does not throttle the airflow through the flowpath. In other words the first spacer material, not the second spacer material, governs the maximum flow rate through the topper flowpath.

In general the SCA's are configured to regulate distribution of the fluid stream in a direction transverse to the principal direction of fluid flow so that the mass flow rate of the fluid is nonuniform in the transverse direction. The SCA's regulate distribution of the fluid stream as a result of 1) the composition of the SCA (e.g. the metals used to produce a shape memory alloy) and/or 2) the shape of the SCA at a temperature TH relative to the shape of the SCA at a temperature TL, where TH>T0 and TL<T0 and/or 3) the orientation of the SCA.

FIGS. 10A-23D are cross sectional elevation views and plan views each illustrating a liner and showing a variety of example actuator shapes, orientations and compositions that may be suitable. The illustrations show the SCA's 54 but not the spacer 50 in the interest of preserving the clarity of the illustrations. The actuators are shown in a baseline state or shape (their state or shape at temperature TL) analogous to the state illustrated in FIG. 6. The actuators are also shown in a non-baseline state or shape (their state or shape at temperature TH) analogous to the state illustrated in FIG. 8. In many of the illustrated examples the actuators are attached to both the upper liner panel 24 and the lower liner panel 26 at respective upper and lower attachment nodes 60 (solid symbols) and 62 (open symbols) however depending on the nature of the actuator it may be satisfactory (or possibly necessary) to attach the actuator to only one of the liner panels, either the upper panel or the lower panel (FIG. 23). In the plan views the upper attachment nodes are illustrated although the upper panel is not. The solid and open symbols are used so that the reader can easily distinguish between the upper and lower nodes, particularly in those plan views where both the upper and lower nodes are visible. (Not all the plan views show both the upper and lower nodes.) The different symbols do not necessarily indicate differences in the modes of attachment at the upper and lower panels. In the following discussion the term "pitch" means the distance between adjacent rows and columns of elements, or equivalently the distance between corresponding points on adjacent elements. For example in FIG. 10B lateral pitch is the distance between adjacent rows; longitudinal pitch is the distance between adjacent columns. In FIG. 14B lateral pitch is the distance between corresponding points on adjacent elements such as the peaks of the arches.

Figure 10C:
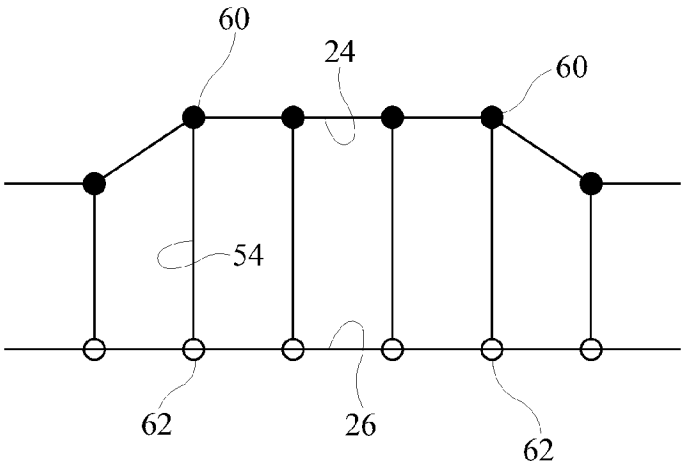
FIGS. 10A, 10B and 10C are a schematic side elevation view of an embodiment of a topper having shape change actuators (SCA's) in the form of linear elements oriented vertically as seen when the temperature is below a critical temperature T0 (FIG. 10A), a plan view (FIG. 10B) taken in the direction 10B-10B of FIG. 10A, and a side elevation view similar to FIG. 10A but as seen when the temperature is above the critical temperature.
Figure 10A:
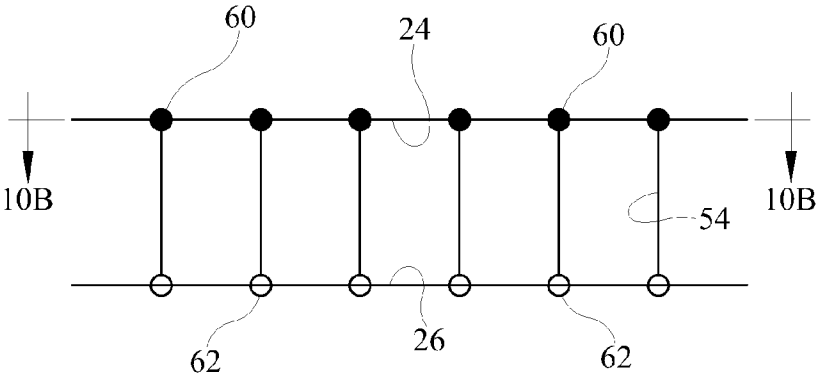
Figure 10B:
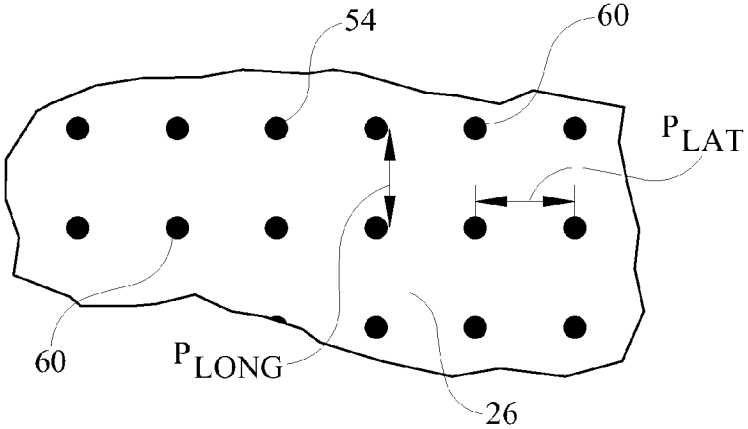

In FIGS. 10A through 10C the SCA's 54 are linear elements oriented vertically. The elements are arranged in a square array with the longitudinal pitch $P_{LONG}$ equal to the lateral pitch $P_{LAT}$ (FIG. 10B). Other arrangements which may be satisfactory include staggered (elements in a given row or column offset from those in a neighboring row or column by one-half pitch) and arrangements in which the lateral pitch and longitudinal pitch are unequal. At temperature TL the elements are relatively short and squat (FIG. 10A). Elements which are at temperature TH take on an elongated shape (FIG. 10C).

Figure 11C:
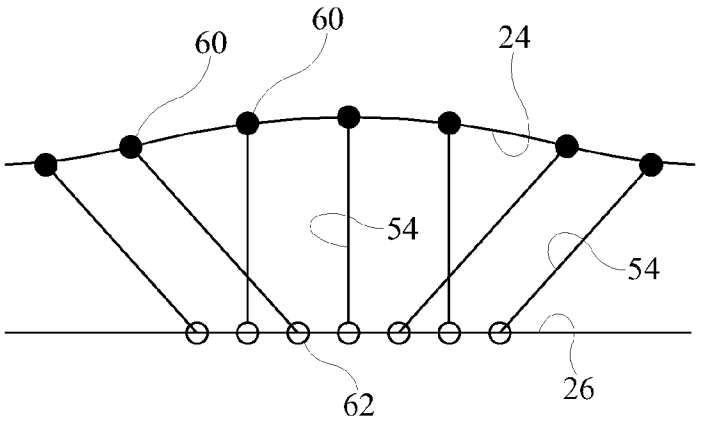
FIGS. 11A, 11B and 11C are views similar to those of FIGS. 10A, 10B and 10C respectively in which the SCA's are a combination of linear elements oriented vertically and linear elements oriented obliquely.
Figure 11A:
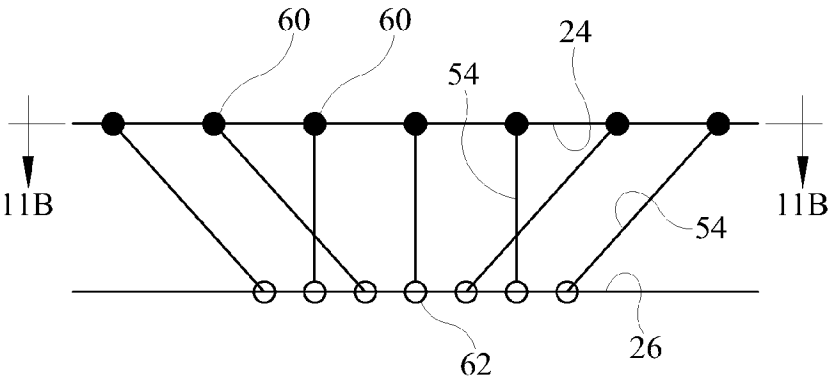
Figure 11B:
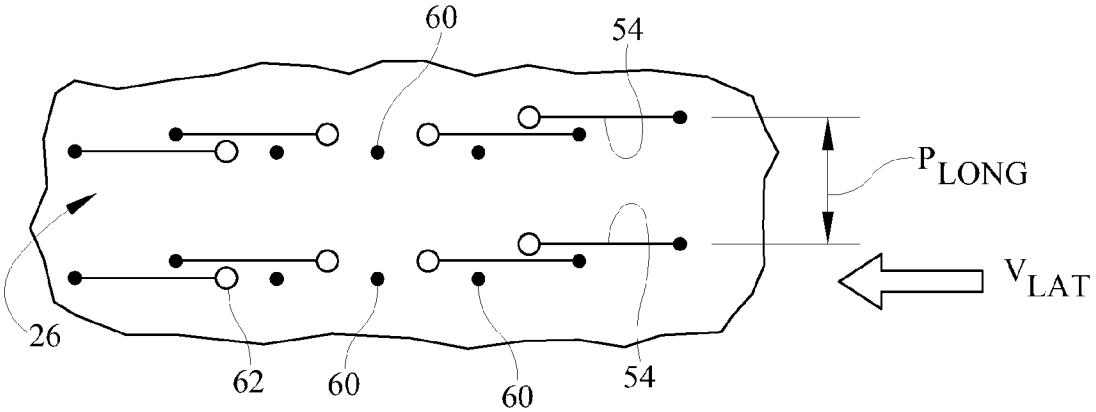

In FIGS. 11A through 11C the SCA's 54 include linear elements oriented vertically and linear elements oriented obliquely. The vertical and oblique elements are intermixed in laterally extending rows with each row longitudinally offset from an adjacent row by a pitch $P_{LONG}$. The elements of a given row are essentially aligned with each other when viewed in the lateral direction, i.e. in the direction of arrow $V_{LAT}$ of FIG. 11B (the slight offset in the illustration is to assist the reader in distinguishing among the different elements 54 in the plan view). Other arrangements which may be satisfactory include one in which rows of exclusively vertical elements alternate with rows of exclusively oblique elements. At temperature TL the elements are relatively short and squat (FIG. 11A). Elements which are at temperature TH take on an elongated shape (FIG. 11C).

Figure 12C:
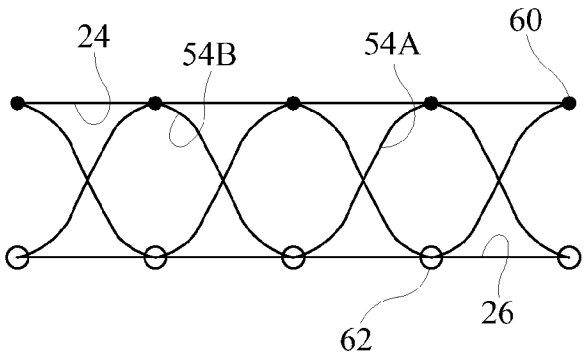
FIGS. 12A, 12B and 12C are views similar to those of FIGS. 10A, 10B and 10C respectively in which the SCA's are serpentine or sinuous elements oriented horizontally.
Figure 12A:
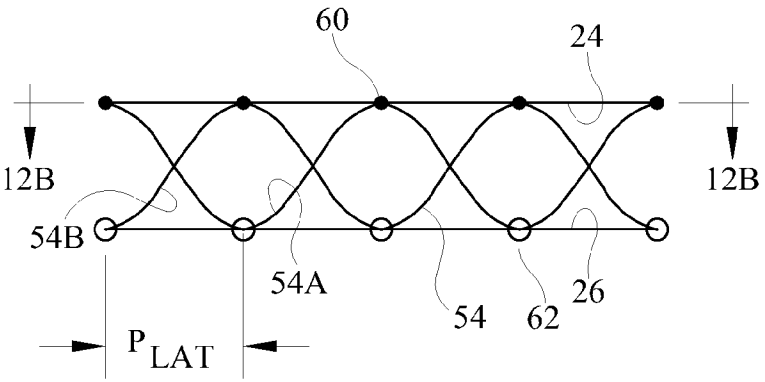
Figure 12B:
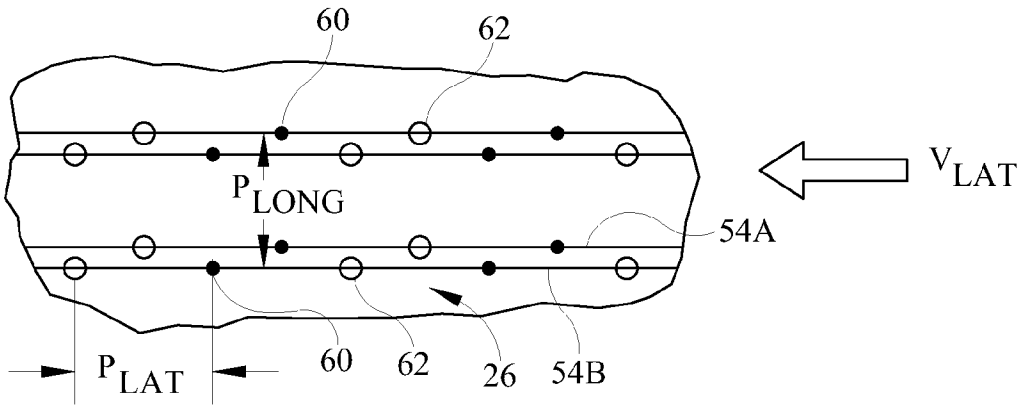

In FIGS. 12A through 12C the SCA's 54 are horizontal serpentine elements. The elements are arranged in laterally extending rows with two serpentines in each row. The serpentines of a given row are essentially aligned with each other when viewed in the lateral direction, i.e. in the direction of arrow $V_{LAT}$ (the slight offset in the illustration is to preserve the clarity of the illustration and help the reader distinguish between the "A" and "B" serpentines in a given row in FIG. 12B). The serpentines of a given row are laterally offset from each other by a pitch $P_{LAT}$ or alternatively by a phase angle of 180 degrees. The rows are longitudinally offset from each other by a pitch $P_{LONG}$. Other arrangements which may be satisfactory include those in which serpentines of different offsets or phase angles are in different rows rather than intermixed in the same row, those in which the offsets are other than 180 degrees, and those having more than two serpentines in a given row. At temperature TL the elements are relatively short. (FIG. 12A). Elements which are at temperature TH take on an elongated shape (FIG. 12C).

Figure 13C:
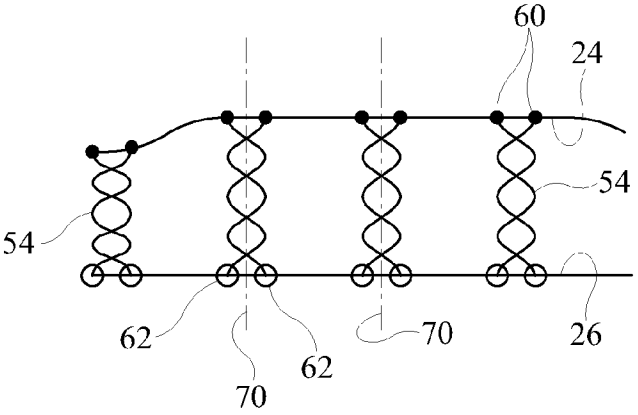
FIGS. 13A, 13B and 13C are views similar to those of FIGS. 10A, 10B and 10C respectively in which the SCA's are serpentine or sinuous elements oriented vertically.
Figure 13A:
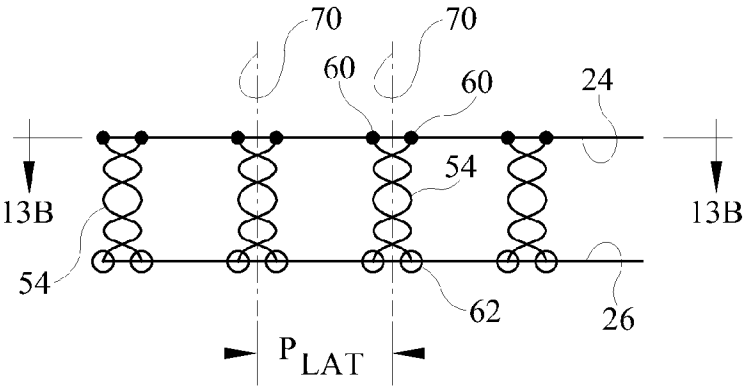
Figure 13B:
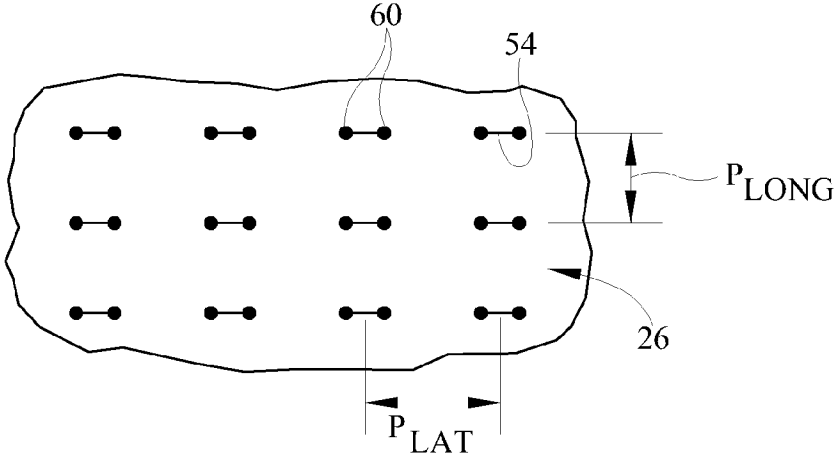

In FIGS. 13A through 13C the SCA's 54 are vertical serpentine elements. The elements are arranged in laterally extending rows and longitudinally extending columns. The elements of a given row are offset from each other by pitch $P_{LAT}$, e.g. the distance between axes 70. The elements of a given column are offset from each other by pitch $P_{LONG}$ where $P_{LONG}$ is less than $P_{LAT}$. Other arrangements which may be satisfactory include a staggered arrangement (elements in a given row or column offset from those in a neighboring row or column by one-half pitch) and arrangements in which the lateral pitch and longitudinal pitch are equal. At temperature TL the elements are relatively short (FIG. 13A). Elements which are at temperature TH take on an elongated shape (FIG. 13C).

Figure 14C:
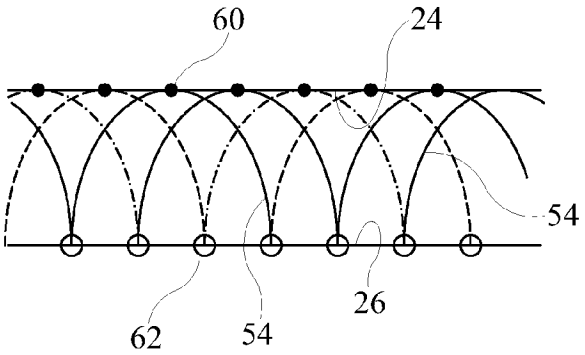
FIGS. 14A, 14B and 14C are views similar to those of FIGS. 10A, 10B and 10C respectively in which the SCA's are arches whose bases are oriented horizontally.
Figure 14A:
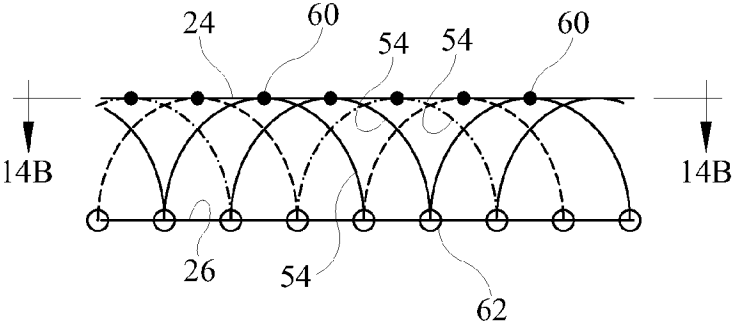
Figure 14B:
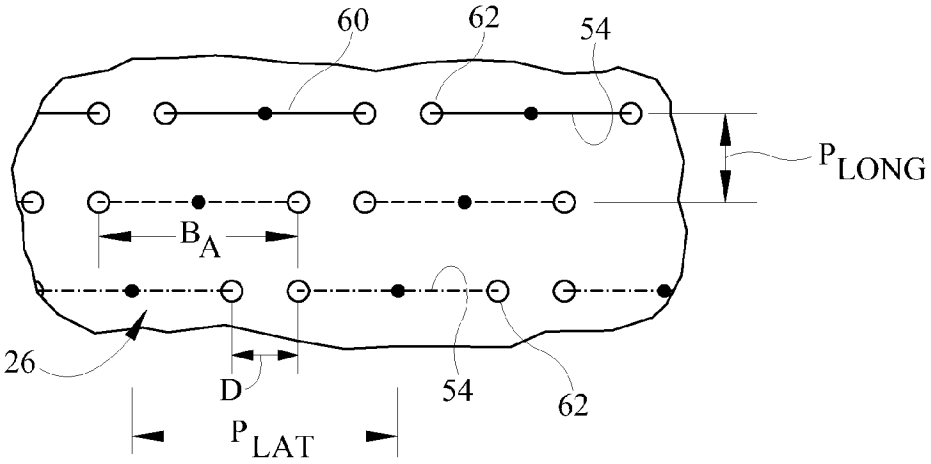

In FIGS. 14A through 14C the SCA's 54 are horizontal arches arranged in laterally extending rows. The lower attachment nodes 62 of any individual arch are spaced from each other by a base distance $B_A$. Adjacent attachment nodes of adjacent arches in the same row are separated by a distance D which is shown as a positive distance in the illustrations. The distance between corresponding points on arches in a given row is the lateral pitch $P_{LAT}$. The rows are offset from each other by pitch distance $P_{LONG}$. The arches of any given row are laterally offset from the arches of an adjacent row by distance D which is one third of base distance $B_A$. Other arrangements which may be satisfactory include one in which the distance D between individual arches of the same row is zero or negative (moving left to right for example, one arch "begins" before the preceding arch "ends"). At temperature TL the elements are relatively short (FIG. 14A). Elements which are at temperature TH take on an elongated shape (FIG. 14C).

Figure 15C:
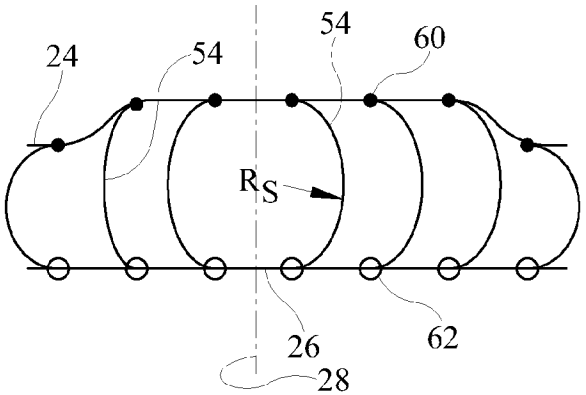
FIGS. 15A, 15B and 15C are views similar to those of FIGS. 10A, 10B and 10C respectively in which the SCA's are arches whose bases are oriented vertically.
Figure 15A:
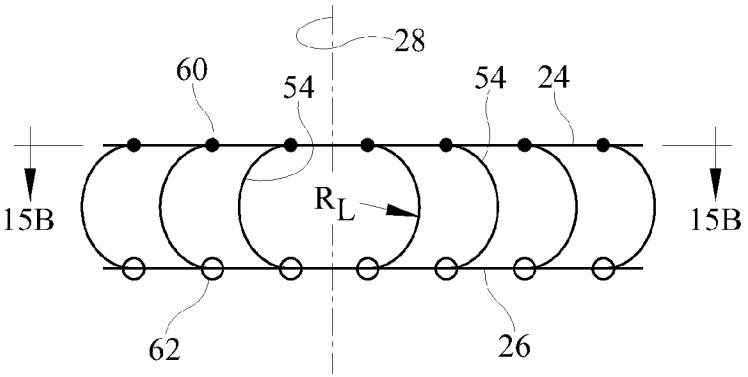
Figure 15B:
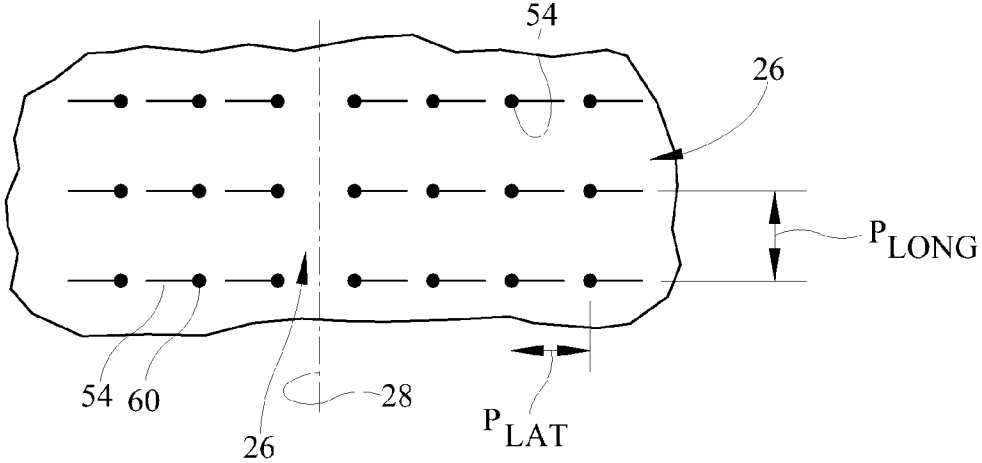

In FIGS. 15A through 15C the SCA's 54 are vertical arches. The arches are arranged in an array with the longitudinal pitch $P_{LONG}$ equal to the lateral pitch $P_{LAT}$ (FIG. 15B). Other arrangements which may be satisfactory include staggered (elements in a given row or column offset from those in a neighboring row or column by one-half pitch) and arrangements in which the lateral pitch and longitudinal pitch are unequal. At temperature TL the elements are relatively short and have a relatively large radius of curvature $R_L$ (FIG. 15A). Elements which are at temperature TH take on an elongated shape and have a relatively small radius of curvature $R_S$ (FIG. 15C).

Figure 16C:
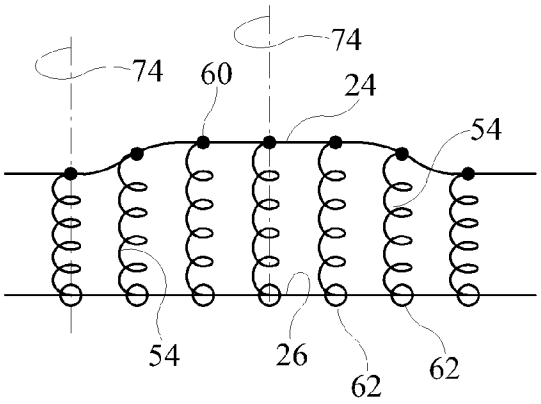
FIGS. 16A, 16B and 16C are views similar to those of FIGS. 10A, 10B and 10C respectively in which the SCA's are coils.
Figure 16A:
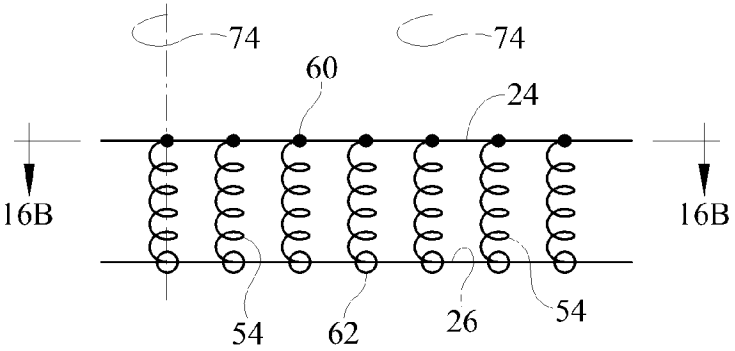
Figure 16B:
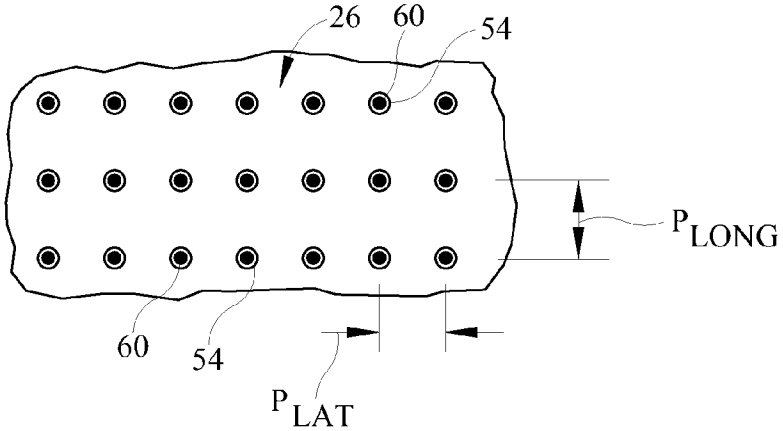

In FIGS. 16A through 16C the SCA's 54 are coils arranged in a rectangular array so that the longitudinal pitch $P_{LONG}$ equals the lateral pitch $P_{LAT}$ (FIG. 15B) and with the coil axes 74 vertical. Other arrangements which may be satisfactory include staggered (elements in a given row or column offset from those in a neighboring row or column by one-half pitch) and arrangements in which the lateral pitch and longitudinal pitch are unequal. At temperature TL the elements are relatively short (FIG. 16A). Elements which are at temperature TH take on an elongated shape (FIG. 16C).

Figure 17C:
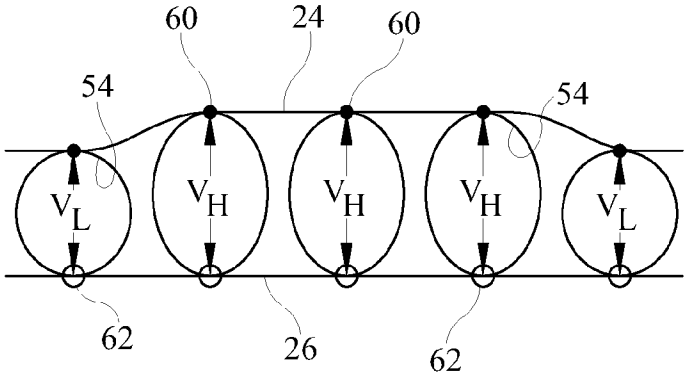
FIGS. 17A, 17B and 17C are views similar to those of FIGS. 10A, 10B and 10C respectively in which the SCA's are rings.
Figure 17A:
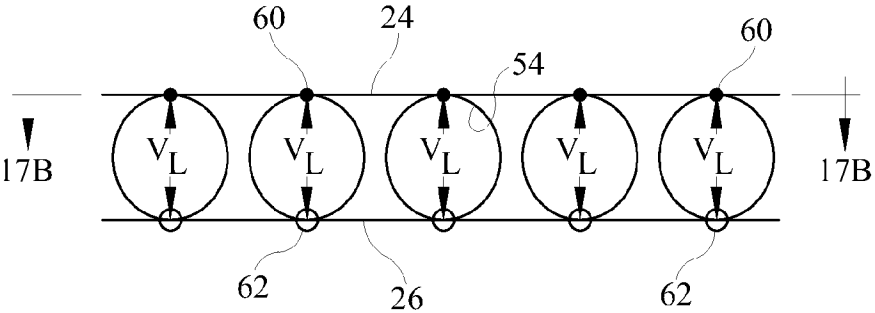
Figure 17B:
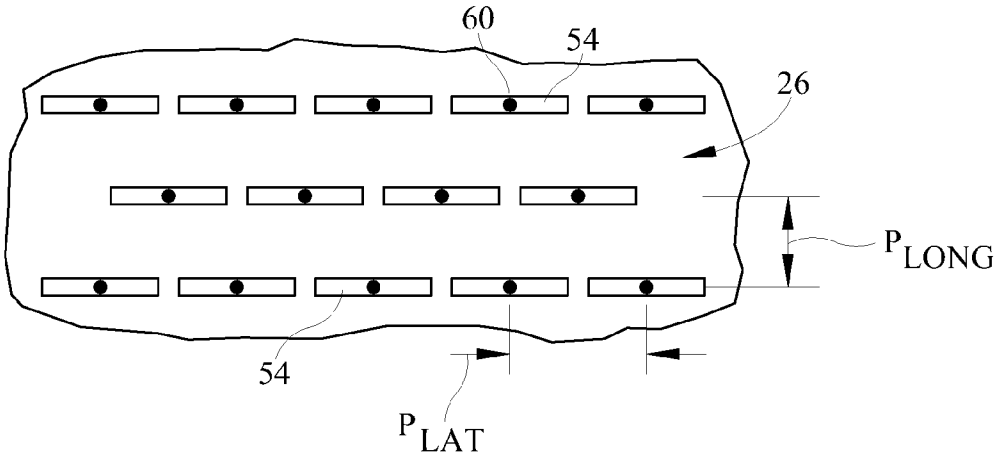

In FIGS. 17A through 17C the SCA's 54 are rings having a vertical height VL. The rings are arranged in a staggered array with the lateral pitch $P_{LAT}$ exceeding the longitudinal pitch $P_{LONG}$. Other arrangements which may be satisfactory include a non-staggered array (e.g. square or rectangular) and arrangements in which the lateral pitch and longitudinal pitch are equal. At temperature TL the elements are circular as seen in an elevation view and have a vertical dimension VL (FIG. 17A). Elements which are at temperature TH take on an elongated shape whose vertical dimension VH is greater than VL (FIG. 17C). In the illustrated example the elements take on a more oval or elliptical shape.

In FIGS. 18A through 18F each SCA 54 is a chain made of stacked or layered ringlets 78. The illustrated examples show the ringlets in three layers, L1, L2 and L3. The chains are arranged in a staggered array with the lateral pitch $P_{LAT}$ equal to the longitudinal pitch $P_{LONG}$. Other arrangements which may be satisfactory include a non-staggered array (e.g. square or rectangular) and arrangements in which the lateral pitch and longitudinal pitch are unequal. At temperature TL the ringlets are circular and each have a vertical dimension DL so that the chain has a vertical dimension VL. (FIG. 18A). The ringlets of elements at temperature TH take on a shape whose vertical dimension DH is greater than DL so that the chain has a vertical dimension VH which is greater than VL (FIG. 18C). In the specific example illustrated the elements take on a more oval or elliptical shape.

The ringlets comprising a chain need not have the same shape change response. Referring to FIG. 18D the ringlets of layers L1 and L3 exhibit a modest response to a change of temperature from TL to TH while the ringlets of layer L2 exhibit a more robust response to the same change of temperature. Such intermixing of ringlets can be used to tailor the response of the chain using an inventory of ringlets that, taken collectively, exhibit only a small number of responses. This is analogous to the way in which a collection of electrical resistors representing only a small number of resistance values can be combined to produce a resistance different from the resistance of any resistor in the collection. The table below provides an illustration. The table shows four classes of shape change elements designated as classes W, X, Y and Z. At a lower temperature TL the elements of all the classes are equal in length. At a higher temperature TH elements from class W elongate by one unit, elements from class X elongate by two units, elements from class Y elongate by three units, and elements of class Z elongate by four units (the elongation is indicated by the numerals within parentheses). As seen in the table elongations of 1, 2, 3, or 4 units can be accomplished with single element from class W, X, Y or Z respectively. An elongation of 4 units can also be obtained by stacking a class W element and a class Y element or by stacking two class X elements. Moreover, the shape change associated with a given class of element can be a foreshortening rather than an elongation.

TABLE 1

Aggregate Elongation of Combinations of SCA's

| Class (elongation) | W (1) | X (2) | Y (3) | Z(4) |
|---|---|---|---|---|
| W (1) | 2 | 3 | 4 | 5 |
| X (2) | 3 | 4 | 5 | 6 |

TABLE 1-continued

| Aggregate Elongation of Combinations of SCA's | | | | |
|---|---|---|---|---|
| Class (elongation) | W (1) | X (2) | Y (3) | Z(4) |
| Y (3) | 4 | 5 | 6 | 7 |
| Z (4) | 5 | 6 | 7 | 8 |

The critical temperature T0 need not be the same for all the ringlets of a chain. FIGS. 18E and 18F show a shape change actuator in the form a chain made of ringlets in which the critical temperature of the ringlets of layer L3 is a relatively low critical temperature T0L and the critical temperature of the ringlets of layer L2 is a relatively higher, midrange critical temperature T0M and the critical temperature of the ringlets of layer L1 is an even higher temperature T0H. At a temperature T1 lower than T0L all the ringlets are in their baseline shape, and therefore so is the chain (as in FIG. 18A). At a temperature T2 which is greater than T0L but less than T0M, those ringlets of layer L3 which are at temperature T2 transition to their elongated state but the ringlets of layers L1 and L2 do not, despite also being at temperature T2 (FIG. 18E). At a temperature T3, which is greater than T0M but less than T0H, those ringlets of layer L2 which are at the temperature T3 transition to their elongated state (FIG. 18F). At an even higher temperature T4 those ringlets of layer L1 which are at temperature T4 transition to their elongated state (not illustrated). As a result the topper exhibits a temporally graduated or temporally staged response.

The foregoing demonstrates the concept of constructing a shape change actuator in the form of a chain by using ringlets having different responses but the same critical temperature (FIG. 18D) and the concept of constructing a shape change actuator of ringlets having the same response to different critical temperatures (FIGS. 18E and 18F). The two concepts can be combined to construct a shape change actuator of both types of ringlets—those that exhibit different responses but have the same critical temperature and those that exhibit the same response to different critical temperatures. Moreover, although a chain comprised of ringlets was used in the foregoing example, the concepts apply equally to shape change elements other than a chain and to sub-elements other than ringlets. Depending on the nature of the stacked sub-elements, the designer can determine whether the sub-elements can be stacked without being connected together or whether the sub-elements should be connected together to define a unitary element.

Figure 19:
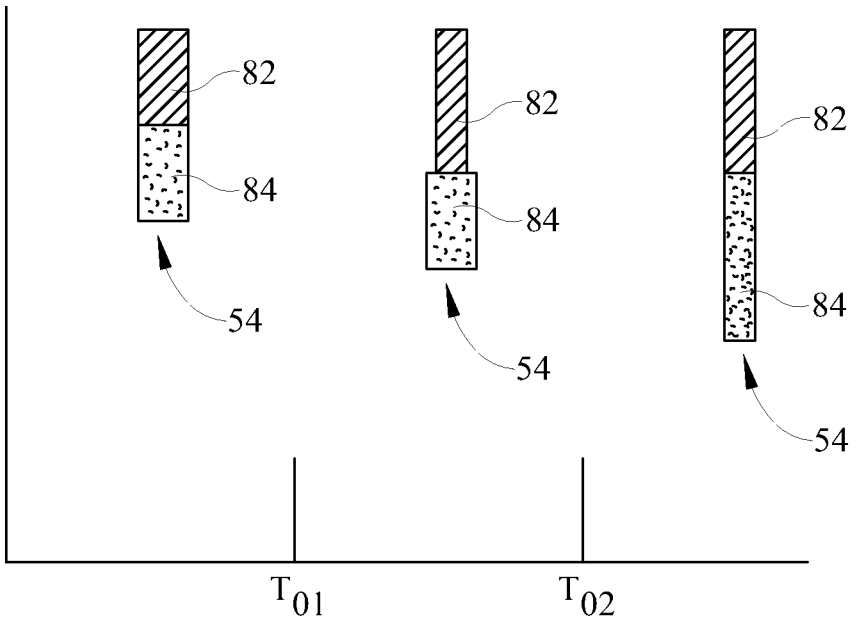
FIG. 19 is a view schematically illustrating behavior of an SCA constructed of sub-elements or portions which have different critical temperatures but which respond similarly as a result of a temperature change across the critical temperature.
Figure 20:
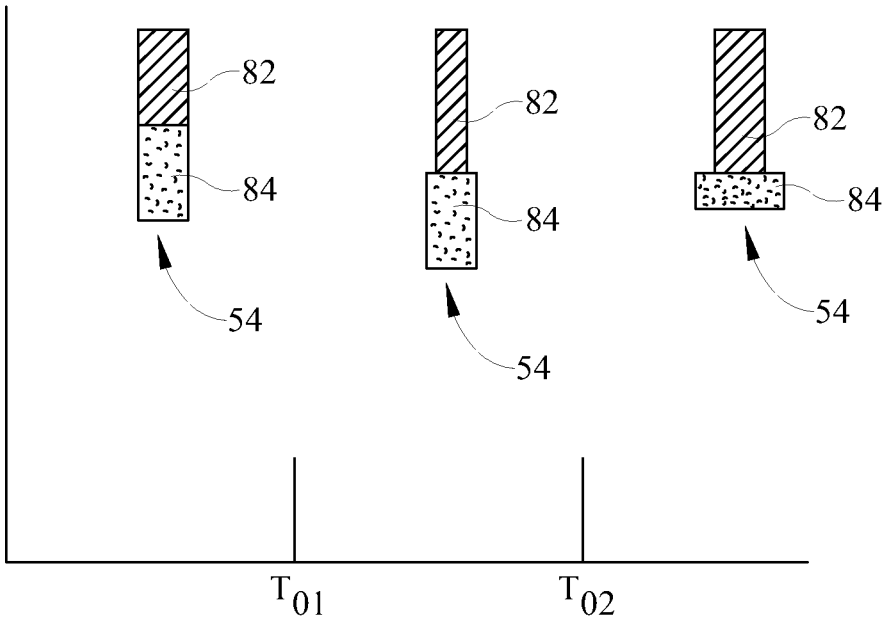
FIG. 20 is a view schematically illustrating behavior of an SCA constructed of sub-elements or portions which have different critical temperatures and which respond differently as a result of a temperature change across the critical temperature.

FIGS. 19-20 schematically show an element 54 comprised of a first portion or sub-element 82 made of a first SCM having a critical temperature of T01 and a second portion or sub-element 84 made of a second SCM having a critical temperature of T02. The element is illustrated as a unitary element whose sub-elements are stacked in series and connected to each other, however the following discussion applies equally well to stacked elements that are not connected to each other. In the limit, T01 may be equal to T02 so that both portions respond to the same critical temperature but not by changing shape the same way (i.e. they exhibit different shape changes). If T01 does not equal T02 the stacked elements respond with a temporally graduated shape change (due to T01 and T02 being achieved at different times). In FIG. 19 each sub-element 82, 84 responds by elongating in response to a temperature change from a temperature below its critical temperature to a temperature above its critical temperature. However element 84 elongates at a higher temperature than does element 82. FIG. 20 shows a similar behavior in which element 84 again has a higher critical temperature than element 82 but responds by contracting rather than elongating.

Figure 21:
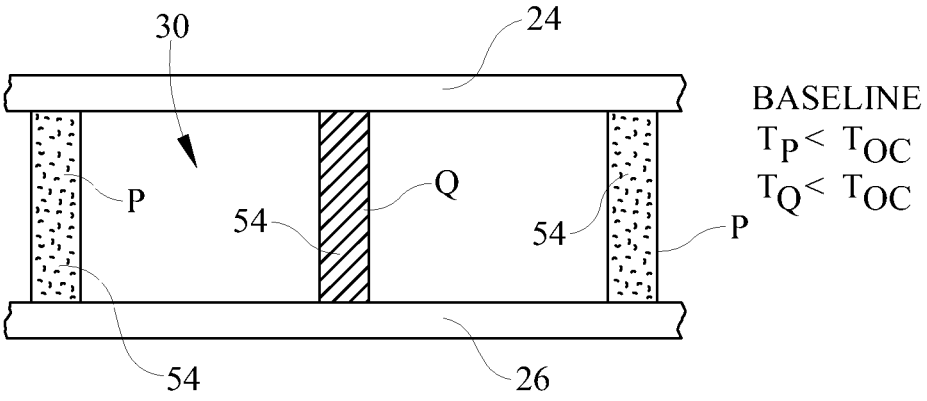
FIG. 21 is a schematic side elevation view of a topper comprised of SCA's having the same critical temperature but which change shape differently, the actuators being spatially intermixed and shown at a temperature TL which is less than the critical temperature.
Figure 22:
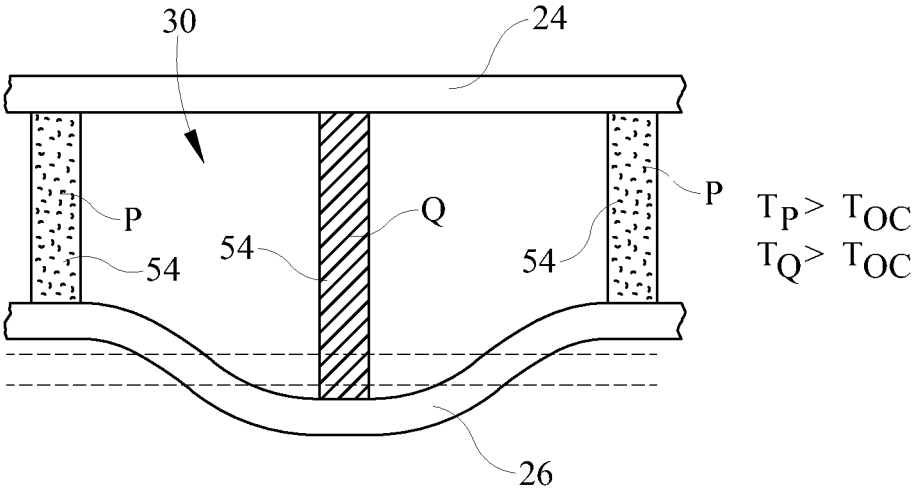
FIG. 22 is a view similar to that of FIG. 21 but showing the topper at a temperature TH which is greater than the critical temperature.

FIGS. 21 and 22 schematically show examples of shape change sub-elements P, Q distributed in parallel to a achieve a spatially dependent shape change. The critical temperature of element P and the critical temperature of element Q are substantially equal. The common critical temperature is denoted as T0C. FIG. 21 shows the baseline state where the temperature TP of element P and the temperature TQ of element Q are both below T0C. At a temperature above T0C element P responds by undergoing a shape change from its baseline shape to a foreshortened shape. Element Q responds by undergoing a shape change from its baseline shape to an elongated shape. As a result liners 24, 26 are pulled toward each other at locations corresponding to elements P and are pushed away from each other at locations corresponding to elements Q. As a result the spacer material (not illustrated) that occupies the interpanel, interior space 30 becomes compressed in the vicinity of elements P thereby offering locally more resistance to airflow, and becomes more distended in the vicinity of elements Q thereby offering locally less resistance to airflow.

In general the arrangement of FIGS. 21-22 include a first class of actuators (represented by element P) made of a first SCM having a first critical temperature of T01 and a second class of actuators (represented by element Q) made of a second SCM having a critical temperature of T02. This is also true of the ringlets 78 of FIGS. 18E-18F.

A temporal component (as seen in FIGS. 19-20) can be added to the spatially distributed shape change (as seen in FIGS. 21-22) by selecting materials that not only respond differently but also have different critical temperatures (which are achieved at different times).

Figure 23C:
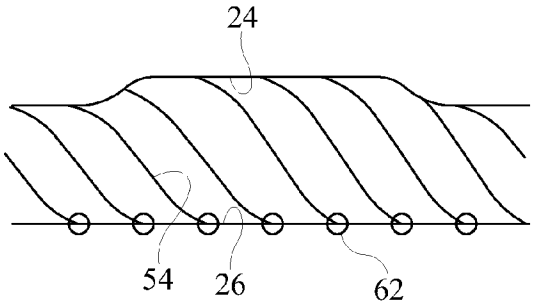
FIGS. 23A, 23B and 23C are views similar to those of FIGS. 10A, 10B and 10C respectively in which the SCA's are cantilevered elements.
Figure 23A:
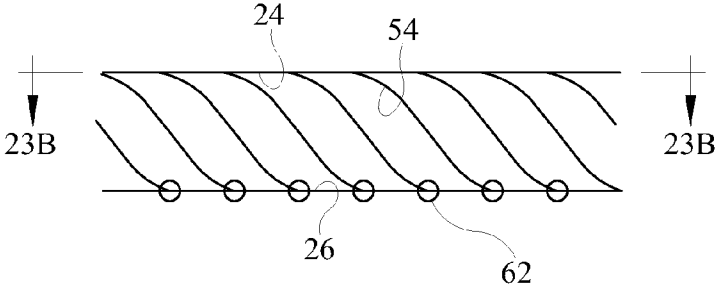
Figure 23D:
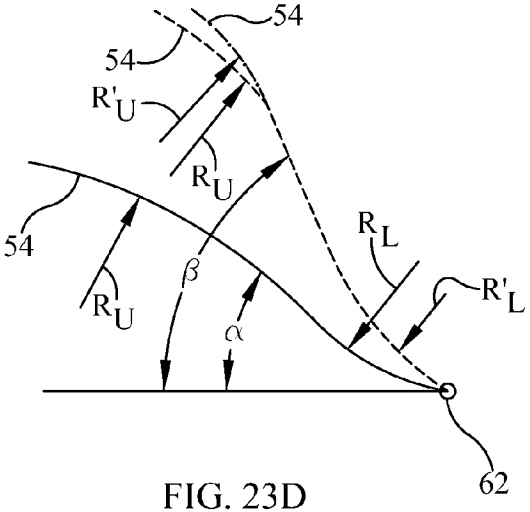
FIG. 23D is an enlarged view of one of the SCA's of FIGS. 23A-23C showing the SCA in a baseline state and in two non-baseline states.
Figure 23B:
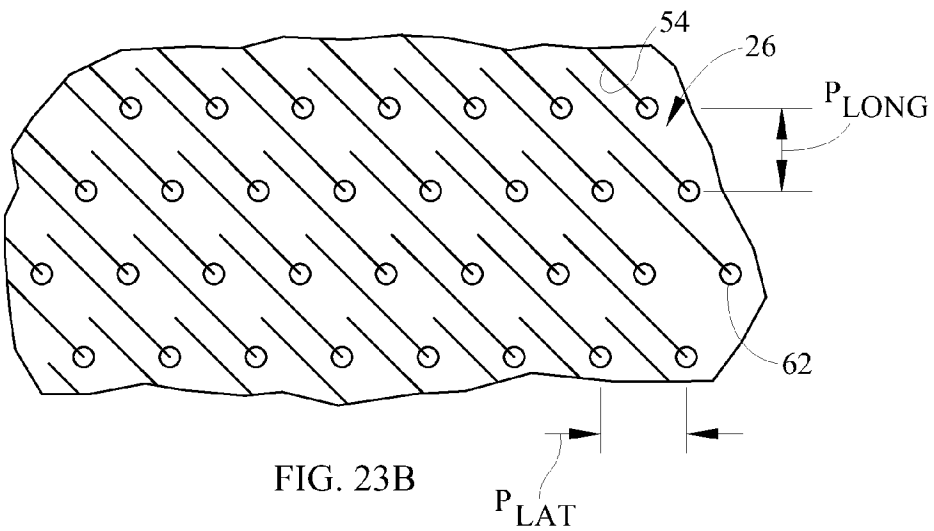

In FIGS. 23A-23D each SCA 54 is a cantilevered element having a curved shape defined by upper and lower radii of curvature $R_U$, $R_L$. As used herein "cantilevered" is used to refer to an element that is attached to one of the panels and projects or extends toward the other panel in a direction having a longitudinal directional component, a lateral directional component, or both, but is not attached to the other panel. The SCA's 54 are attached to liner lower panel 26 at attachment nodes 62. The lower attachment nodes 62 are arranged in a staggered array in which the longitudinal pitch $P_{LONG}$ equals the lateral pitch $P_{LAT}$ (FIG. 23B). Other arrangements which may be satisfactory include a non-staggered array and arrangements in which the lateral pitch and longitudinal pitch are unequal. In the example each SCA is oriented at an angle of about 45 degrees as seen in plan view (FIG. 23C). At temperature TL each SCA projects toward upper panel 24 at a relatively shallow angle $\alpha$ of about 40 degrees as seen in side elevation (FIG. 23C and FIG. 23D solid line). At temperature TH the element undergoes a shape change in which the lower radius of curvature, now designated by $R_L'$, becomes smaller (FIG. 23D, dashed line) with the result that the element becomes reoriented at a steeper angle $\beta$ of about 70 degrees. If desired the non-baseline shape could be one in which upper radius of curvature increases to $R_U'$ (FIG. 23D, dash-dot line) in order to augment the effect of the shape change. In the example of FIGS. 23A-23D, the filler regulates fluid flow substantially as a result of a change of curvature of the SCA's. As with other embodiments the change of curvature may be a function of a solid state phase change of the SCM as a function of temperature or may be due to some mechanism other than a solid state phase change.

Figure 24:
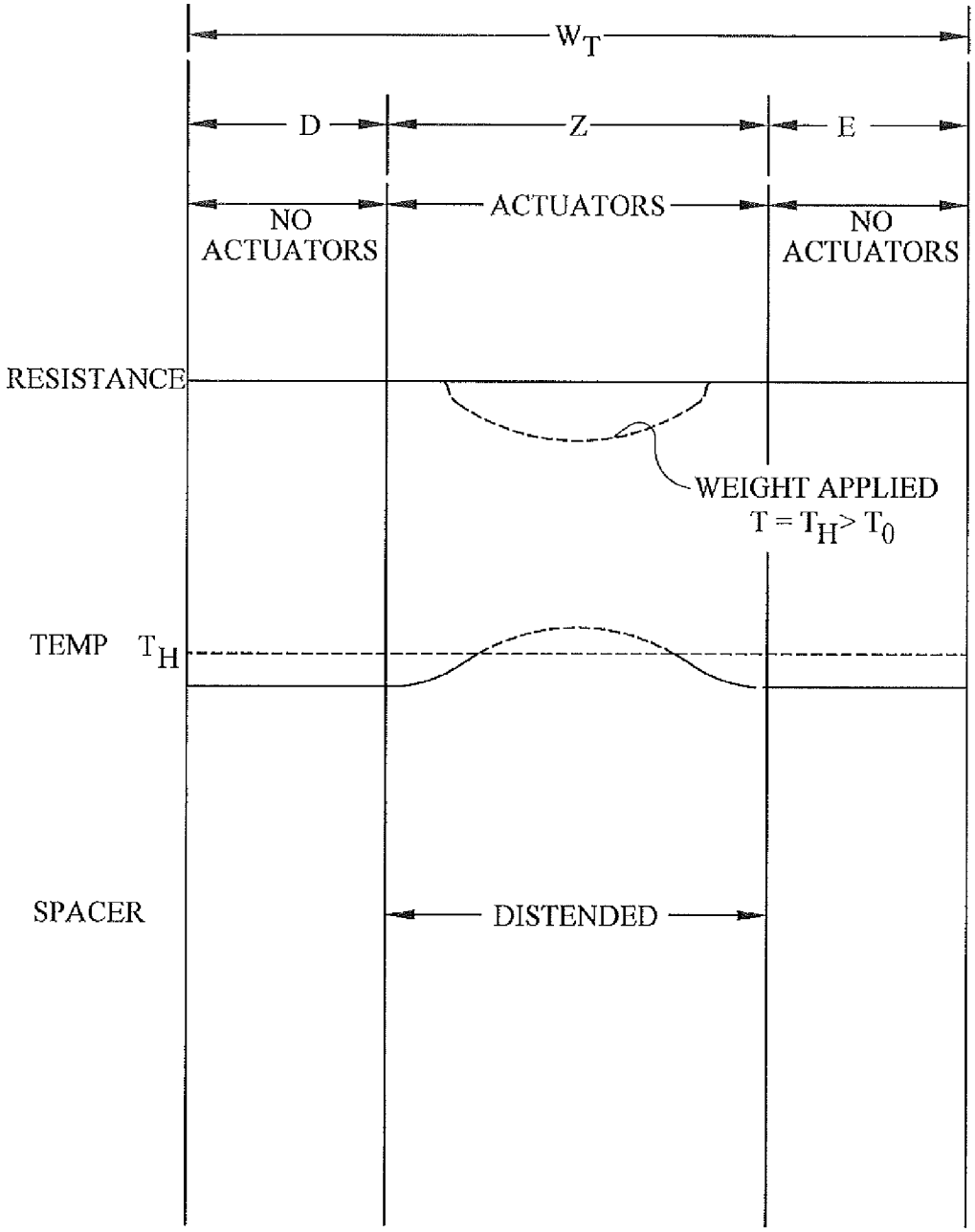
FIG. 24 is a graphical representation of actuator distribution, spacer response, fluid flow resistance and temperature in a topper in which the actuators are distributed transversely across only a first part of the width of the topper.

Referring again to FIG. 5 along with FIG. 24 the SCA's may be distributed transversely (e.g. laterally) across only a first part of the width such as across laterally interior zone Z, but not across other part or parts of the width such as right and left flank sections D, E. When the SCA's are distributed across only the first part of the width the SCA's are configured so that at temperature TH the first part of the width which is subject to temperature TH exhibits less resistance to fluid flow than other part or parts of the width which are at temperature TL.

Figure 25:
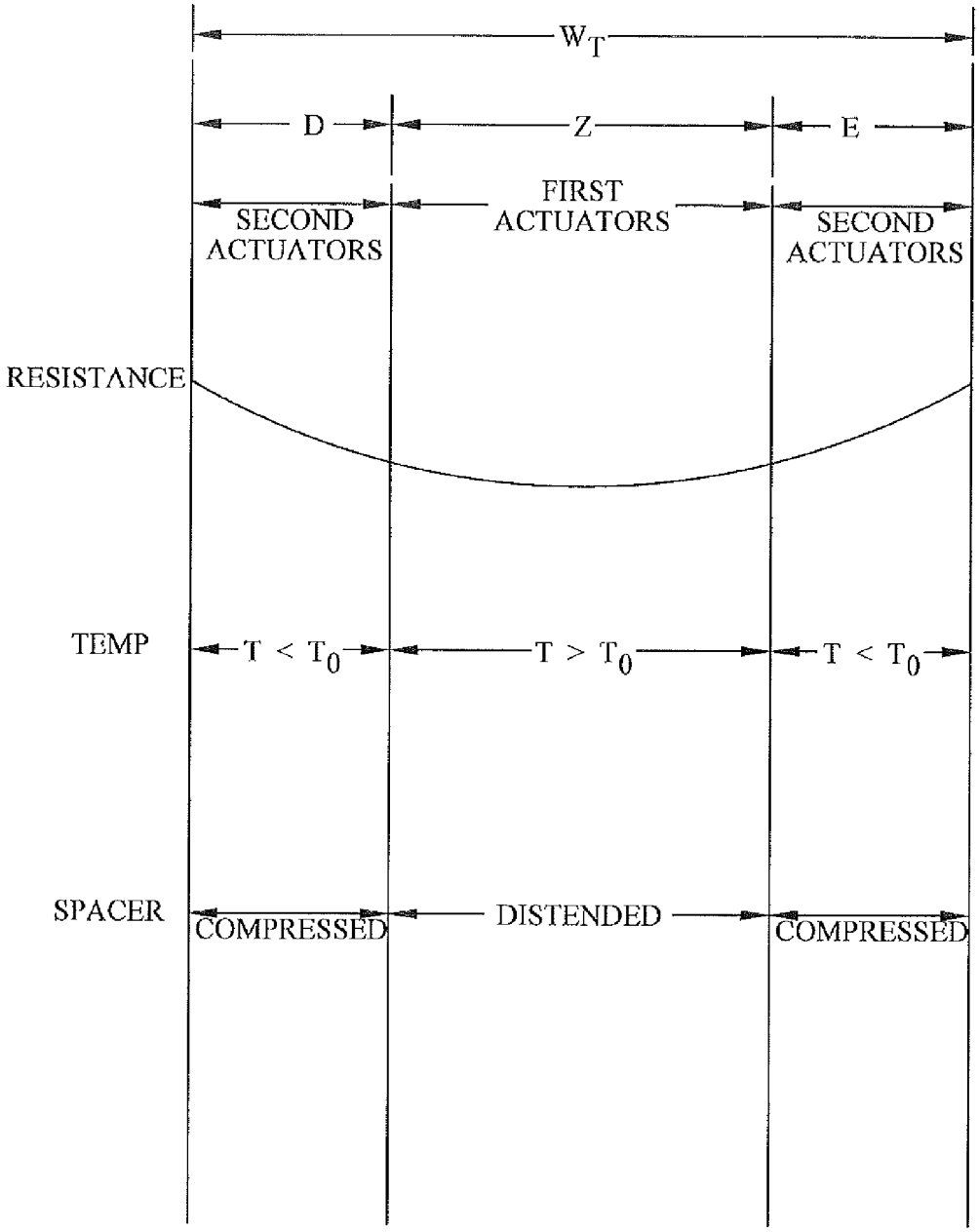
FIG. 25 is a graphical representation similar to that of FIG. 24 in which actuators are distributed across a part or parts of the width of the topper other than the first part of the width.
Figure 26:
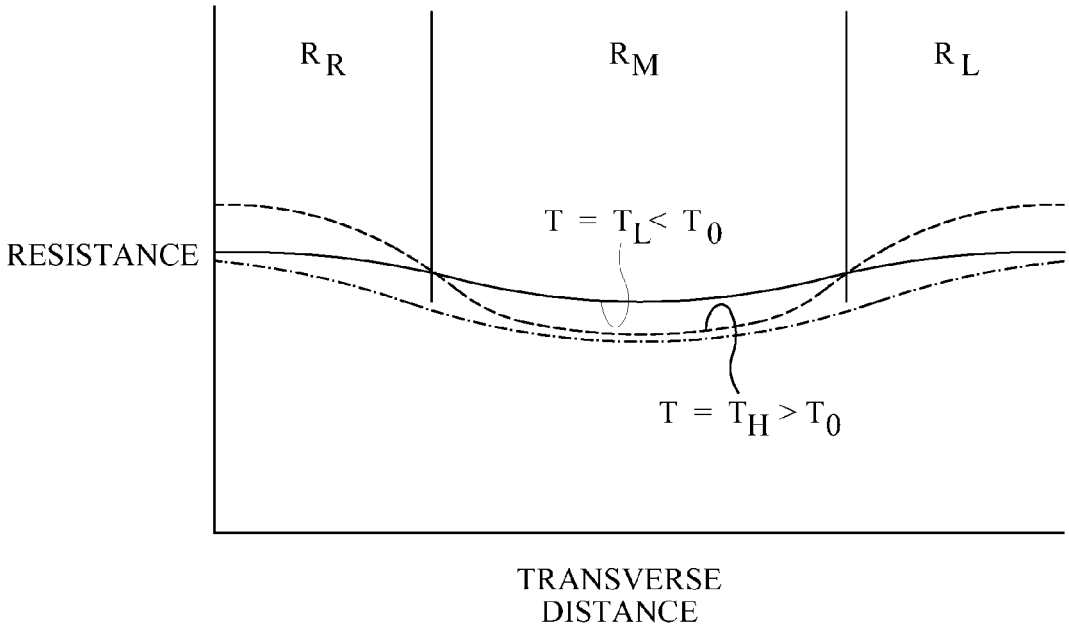
FIG. 26 a graph showing fluid flow resistance profiles in the transverse direction in an example baseline state and two example non-baseline states.

Referring to FIG. 5 and also to FIG. 25 the SCA's may alternatively be distributed across the other part or parts of the width in addition to being distributed across the first part of the width. In that case the actuators of the first part are first actuators, and the actuators distributed across the other part or parts are second actuators. The first actuators are configured to distend the spacer at temperatures above T0. The second actuators are configured to compress the spacer at temperatures below T0. As a result the first part of the width which is subject to temperature TH exhibits less resistance to fluid flow and the other part or parts of the width which are at temperature TL exhibit greater resistance As seen in FIG. 26 a graph of fluid flow resistance versus distance in the transverse direction defines a resistance profile of the interior space 30. The resistance profile is a measure of resistance to fluid flow in the principal direction. The SCA's are distributed in the interior space to adjust the resistance profile in response to temperature. For example the solid line of the graph of FIG. 26 shows a baseline resistance profile that is slightly higher at the left and right edges of the topper and slightly lower toward the center at temperature TL (solid line). In other topper variants the baseline resistance profile in the lateral (transverse) direction could instead be uniform. The dash-dot line of FIG. 26 shows a non-baseline profile resulting from the actuators having adjusted the resistance in response to being at temperature TH. The non-baseline profile, like the baseline profile, is nonuniform in the transverse direction, but is more decidedly so. In another non-baseline profile (dashed line) the actuators have distended the spacer in a medial region $R_M$ but have compressed the spacer in left and right lateral regions $R_L$, $R_R$. Both the baseline and nonbaseline resistance profiles are attributable principally to the density of the spacer material in the interior space, which density is affected by the response of the SCA's to temperature. In particular the SCA's respond to the higher temperature TH by distending the spacer thereby decreasing the density of the spacer or allowing the spacer to distend as a result of fluid flowing through the spacer and/or the elasticity of the spacer material. Some of the SCA's may alternatively respond to the higher temperature TH by compressing the spacer thereby locally increasing the density of the spacer and therefore diminishing the local fluid flow rate.

Figure 27A:
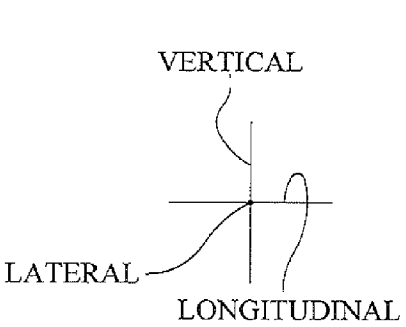
FIG. 27A is a schematic plan view in the direction 27A-27A of FIG. 27 showing an insulative overlay with shape change material, embodied as shape change elements, present in only one or more zones (A and Z) of the overlay and in which the zones A and Z collectively define less than the entire overlay.
Figure 27A:
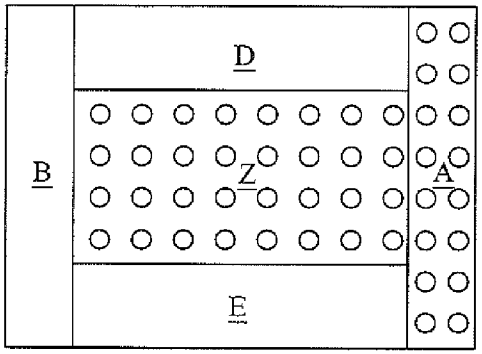
Figure 27:
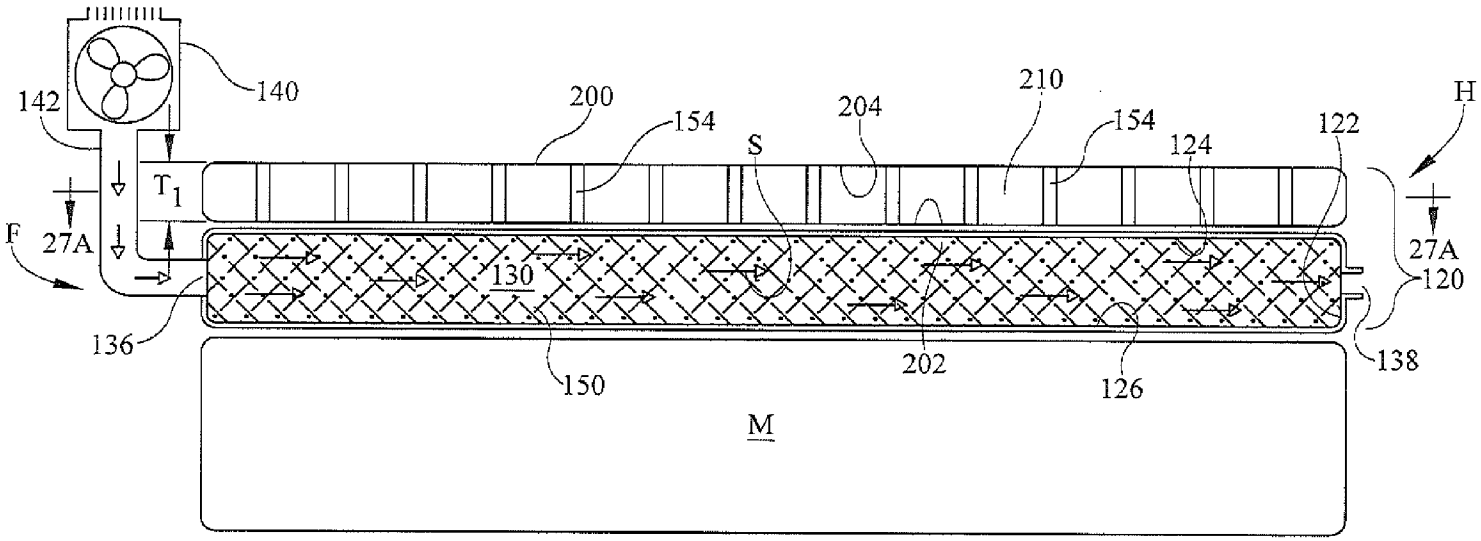
FIGS. 27, 28 and 29 are a schematic left side elevation views of a topper assembly including a conduit formed by liner panels and an overlay having shape change actuators in an inner space thereof as seen when the temperature is below a critical temperature T0 and without the weight of a patient (FIG. 27), after application of patient weight (FIG. 28) and after application of patient weight but as seen when the temperature is above the critical temperature (FIG. 29).

FIG. 27 is a schematic left side elevation view of a topper assembly 120 which extends longitudinally from a head end H to a foot end F. FIG. 27 also includes a set of axes to show the longitudinal, lateral and vertical directions. The topper assembly includes a liner 122 comprised of upper and lower liner panels 124, 126 which define an interpanel interior space 130. A gas inlet 136 and a gas outlet 138 penetrate through the liner at the foot and head ends respectively. A blower 140 is connected to the topper inlet by an air supply conduit 142. A spacer material 150 occupies the interior space and is illustrated schematically by dash-dot crosshatch lines. During operation the blower propels a stream of coolant S, usually ambient air, through the interior space from inlet 136 to outlet 138. Accordingly the liner serves as a conduit and the interior space 130 serves as a fluid flowpath 144 whose boundary is defined by liner 122. FIG. 27A shows an embodiment in which the shape change material, embodied as shape change elements 54 are present in only one or more zones (head segment A and interior zone Z) of the overlay and in which the zones A and Z collectively define less than the entire overlay, which includes foot zone B and flank sections D, E.

The topper assembly also includes an insulative overlay 200 having a conduit side panel 202 proximate to the conduit, an occupant side panel 204 remote from the conduit and an inner space 210 between the panels. A set of shape change elements or shape change actuators (SCA's) 154 each having a critical temperature T0 is distributed in the inner space of the insulative overlay. A suitable insulating material also occupies the inner space. One suitable insulating material is air. The overlay may include inlet and/or exhaust ports for introducing or venting the air from the inner space, for example to adjust the air pressure in the inner space in order to improve occupant comfort, however there is not a continuously flowing fluid stream analogous to the fluid stream S that flows through the liner interior space 130. Instead the air in the inner space 210 acts as a static insulating layer whose resistance to heat transfer increases with increasing thickness T of the layer and decreases with decreasing thickness T of the layer.

The topper assembly may be permanently integrated with a mattress M or may be a separate component which can be placed atop the mattress or removed from the mattress as necessary. Similarly the overlay may be permanently integrated with the conduit (i.e. with liner 122) or may be a separate component which can be placed atop the liner or removed from the liner as necessary.

Figure 28:
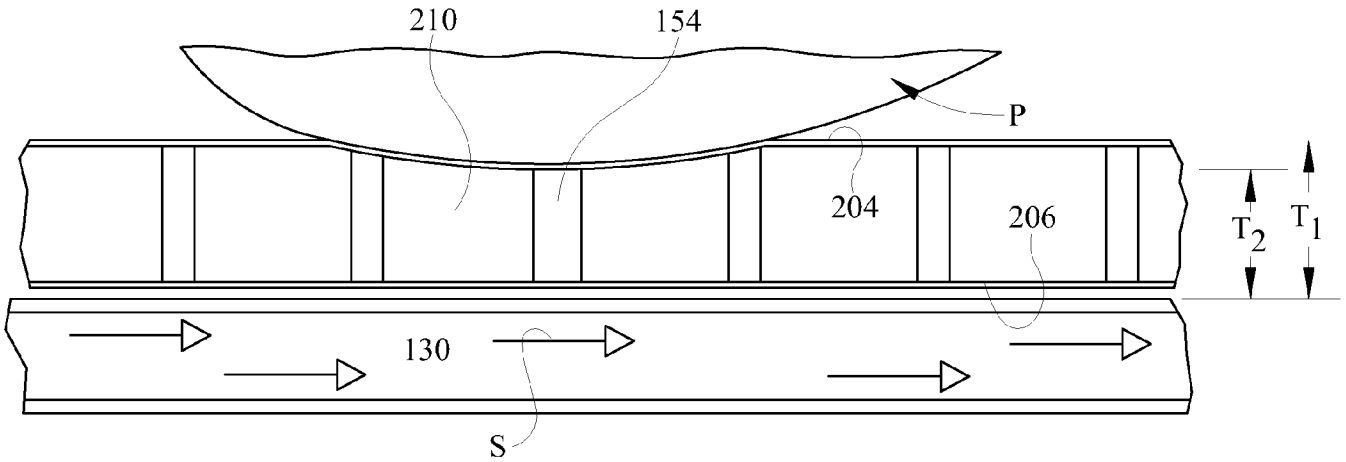
Figure 29:
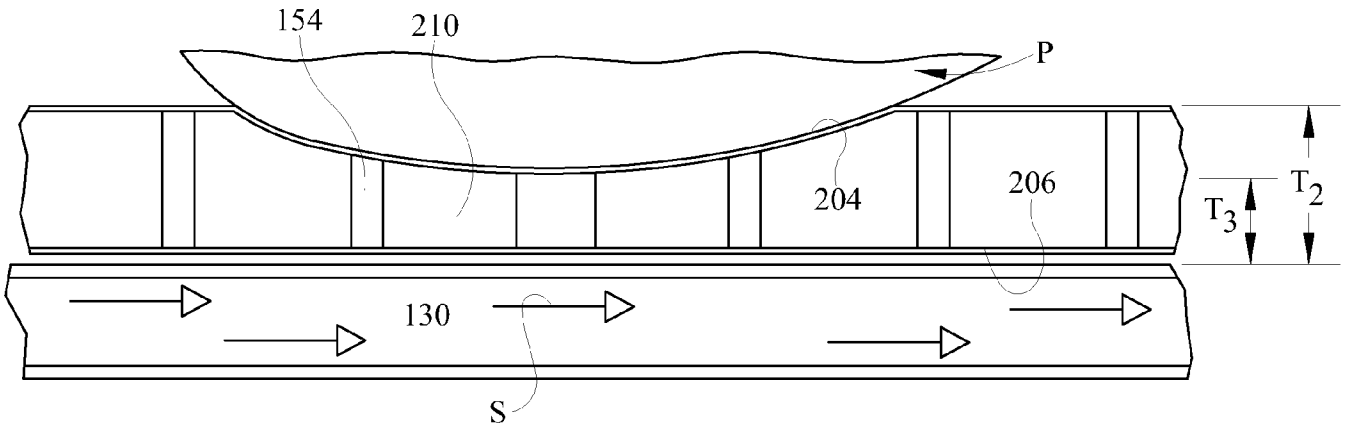

Referring additionally to FIGS. 28 and 29 the shape change elements 154 are configured to adjust the heat transfer resistance of the insulative overlay in response to temperature. In particular the elements are distributed such that the heat transfer resistance of the overlay is lower at a high temperature TH which is higher than the critical temperature and higher at a low temperature TL which is lower than the critical temperature. As seen in FIG. 28 the weight of a body part of a patient P bears on the topper assembly. The weight compresses some of the shape change elements and therefore locally compresses the overlay from a thickness T1 (shown in FIGS. 27 and 28) to a reduced thickness T2 (FIG. 28). The reduced thickness of the insulating air layer in inner space 210 results in additional heat transfer through the overlay and into the conduit formed by the liners 122, 124. Although this is beneficial for guarding against the formation of pressure ulcers, the increased heat transfer may not be enough to prevent an unsatisfactorily large temperature rise at the locale where the patient's weight bears on the topper. As a result the patient may still have an elevated susceptibility to the formation of pressure ulcers. If the temperature rises to TH, the SCA's change shape in a suitable manner to further compress the overlay (and further reduce the local thickness of the insulative air layer) to T3 (FIG. 29). This further reduction in the thickness of the insulating air layer promotes additional heat transfer vertically across the overlay and into the interior space 130 where the heat is carried away by fluid stream S. If the additional heat transfer causes the local temperature to fall below T0, specifically to TL, the SCA's revert to their baseline shape of FIG. 27 or their deformed state of FIG. 28. The cycle or a portion thereof may then repeat itself.

In FIGS. 27-29 the shape change actuators are illustrated as columnar elements that become shorter and more squat when weight is applied (FIG. 28 vs. FIG. 27) and that become even more short and squat in response to the shape memory effect (FIG. 29 vs. FIG. 28). However elements having low temperature (TL) and high temperature (TH) shapes and forms are also suitable provided they respond to TH by reducing the thickness of the insulating layer as seen in FIG. 29 relative to FIG. 28. Moreover the previously describe variations involving the intermixing of actuators exhibiting different shape changes and/or having different critical temperatures apply equally to the topper of FIGS. 27-29.

Figure 30:
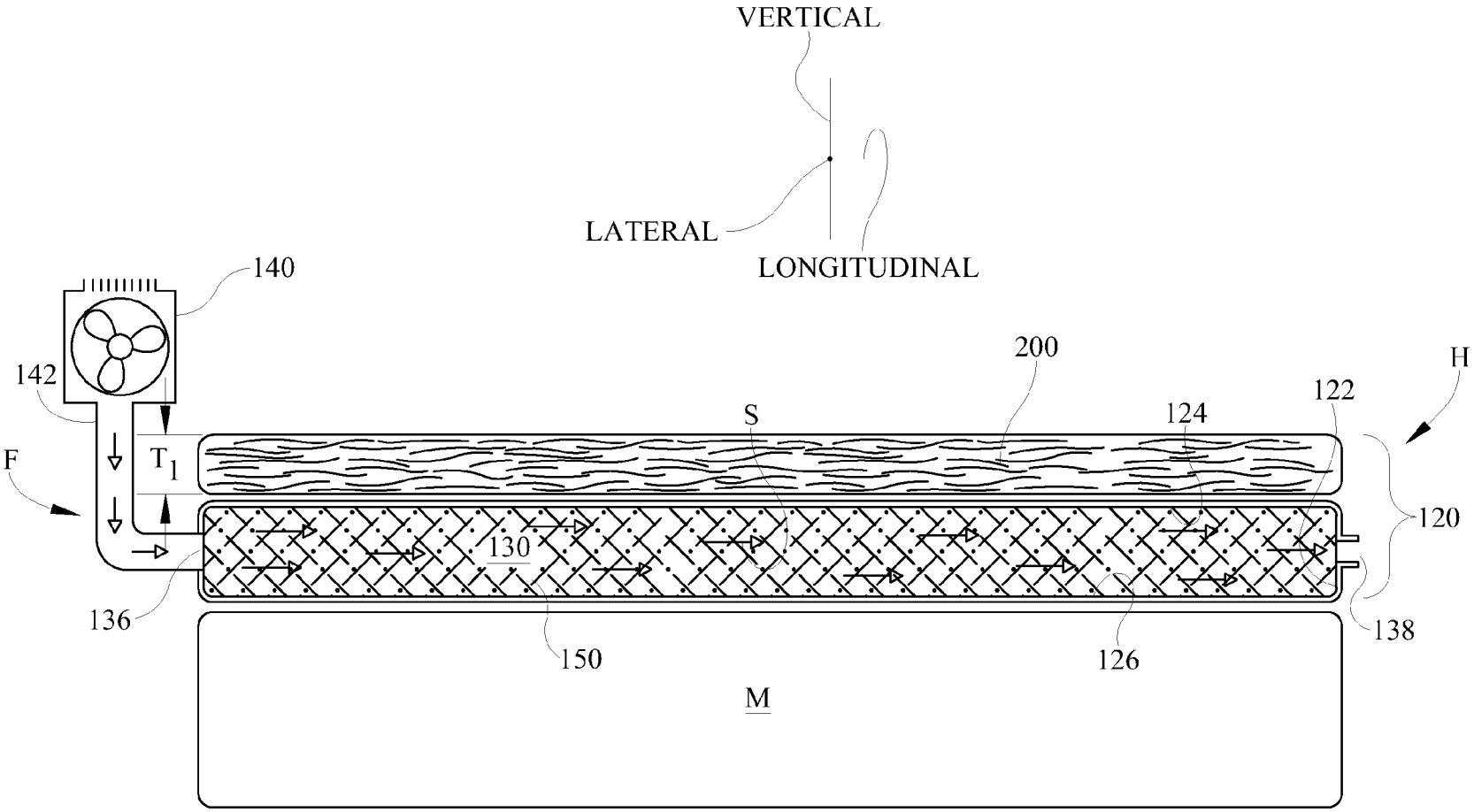
FIGS. 30, 31 and 32 are schematic left side elevation views similar to those of FIGS. 27-29 in which the overlay is a sheet not having an inner space.
Figure 31:
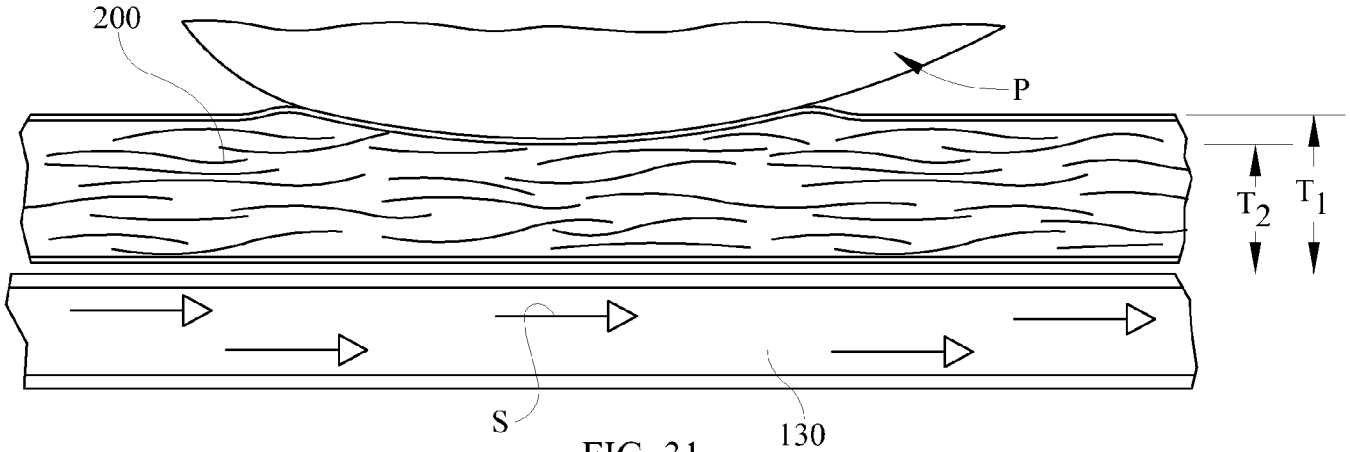
Figure 32:
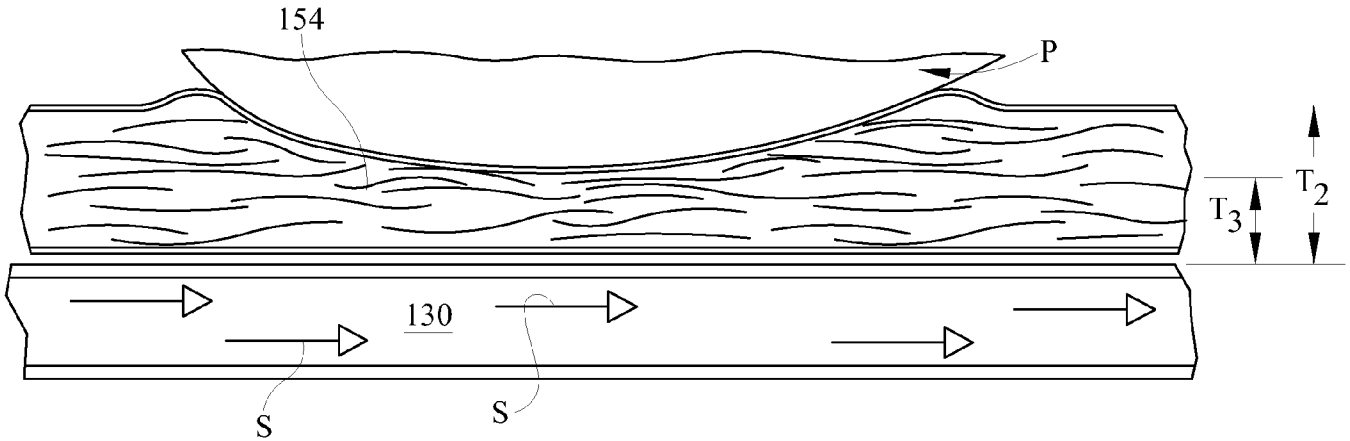

FIGS. 30-32 are views similar to those of FIGS. 27-29 showing a topper assembly similar to that of FIGS. 27-29 but one in which the overlay 200 is an insulative overlay sheet made of a shape change material (SCM). The sheet does not have an insulative inner space such as space 210 of FIGS. 27-29. Instead the insulating property of the overlay results from the heat transfer resistance of the SCM itself rather than the heat transfer resistance of a trapped air layer (as in FIGS. 27-29). The properties of the SCM include a critical temperature T0. The material is responsive to temperature such that the thickness at a temperature TH, which is higher than the critical temperature, is less than the thickness at a temperature TL, which is lower than the critical temperature. The heat transfer resistance of the overlay increases with increasing thickness of the shape change material and decreases with decreasing thickness of the shape change material.

The topper assembly may be permanently integrated with a mattress M or may be a separate component which can be placed atop the mattress or removed from the mattress as necessary. Similarly the overlay may be permanently integrated with the conduit (i.e. with liner 122) or may be a separate component which can be placed atop the liner or removed from the liner as necessary.

The insulative, shape change sheet adjusts the heat transfer resistance of the insulative overlay in response to temperature. The heat transfer resistance of the overlay is lower at a high temperature TH which is higher than the critical temperature and higher at a low temperature TL which is lower than the critical temperature. As seen in FIG. 31 the weight of a body part of a patient P bears on the topper assembly. The weight locally compresses the overlay from a thickness T1 (shown in FIGS. 30 and 31) to a reduced thickness T2. The locally reduced thickness of the sheet, and the attendant reduction in its heat transfer resistance, permits additional heat transfer through the overlay and into the conduit formed by the liner panels 124, 126. Although this is beneficial for guarding against the formation of pressure ulcers, the increased heat transfer may not be enough to prevent an unsatisfactorily large temperature rise at the locale where the patient's weight bears on the topper. As a result the patient may still have an elevated susceptibility to the formation of pressure ulcers. If the temperature rises to TH, the shape memory property of the sheet causes its thickness to change to thickness T3. This further reduction in the thickness of the material permits additional heat transfer vertically across the overlay and into the interior space 130 where the heat is carried away by fluid stream S. If the additional heat transfer causes the local temperature to fall below T0, specifically to TL, the sheet reverts to its baseline shape of FIG. 30 or to its deformed state of FIG. 31. The cycle or a portion thereof may then repeat itself.

Figure 33:
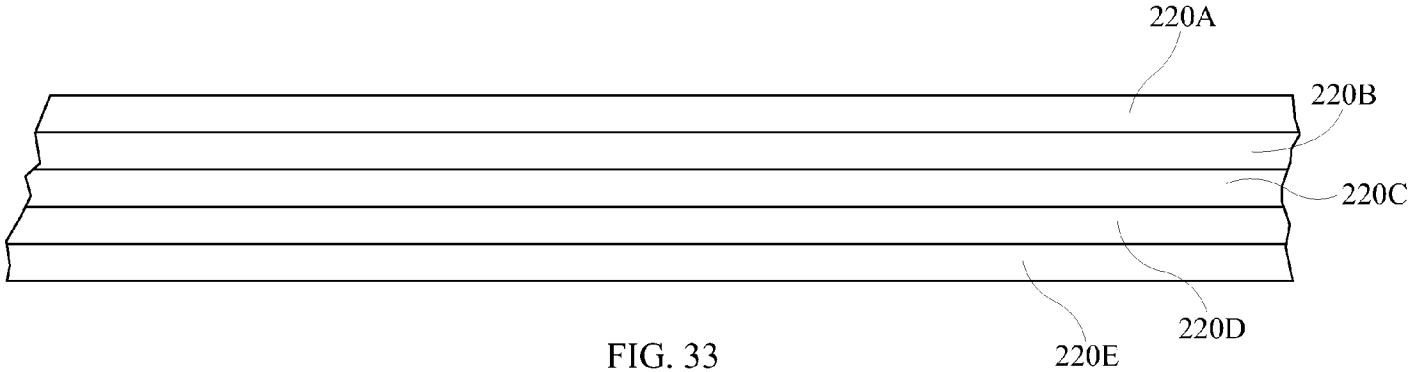
FIG. 33 is a schematic elevation view of an overlay sheet similar to the sheet of FIGS. 30-32 but constructed of layers of shape change materials in which the layers exhibit different shape changes and/or have different critical temperatures.
Figure 34:
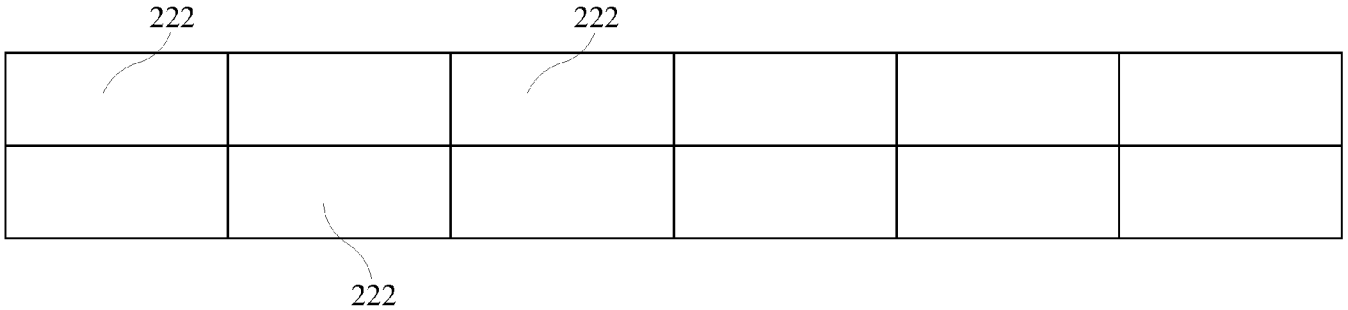
FIG. 34 is a schematic plan view of an overlay sheet similar to the sheet of FIGS. 30-32 but constructed as a patchwork sheet made of patches of shape change materials in which the patches exhibit different shape changes and/or have different critical temperatures.
Figure 35:
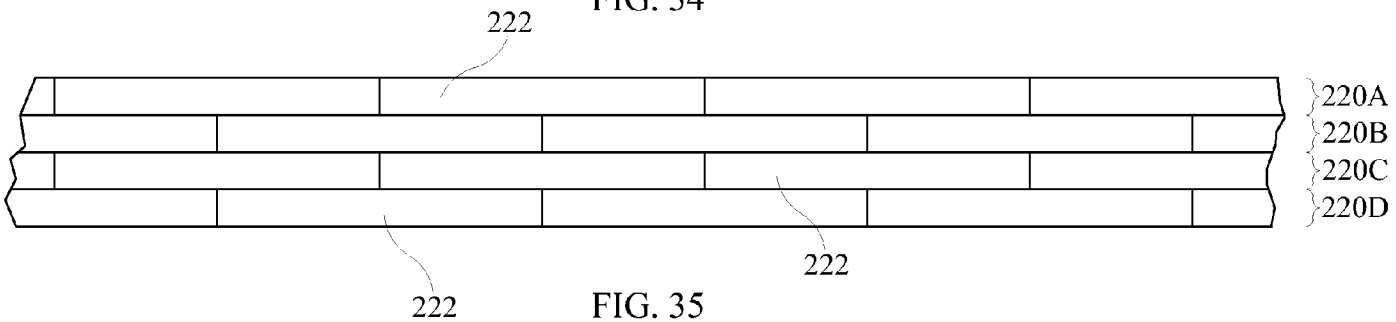
FIG. 35 is an elevation view of an overlay sheet similar to the sheet of FIGS. 30-32 but constructed of a combination of layers such as the layers of FIG. 33 and patches such as the patches of FIG. 34.

FIGS. 30-32 show a sheet whose shape change properties are spatially uniform. In other words all portions of the sheet respond the same way at temperature TL and temperature TH. The elevation view of FIG. 33 shows how a spatially and/or temporally tailored response can be achieved by constructing the sheet of layers 220 of shape change materials in which the layers exhibit different shape changes and/or have different critical temperatures. The plan view of FIG. 34 shows how a spatially and/or temporally tailored response can be achieved by constructing a patchwork sheet made of patches 222 of shape change materials in which the patches exhibit different shape changes and/or have different critical temperatures. The elevation view of FIG. 35 shows a combination of layers 220 and patches 222.

The examples of the foregoing description are prophetic. Many of the examples involve SCA's whose baseline shape is a relatively elongated shape and whose non-baseline shape is a relatively short and squat shape. Other pairs of shapes are also satisfactory provided the shape change provokes the adjustment of fluid flow resistance and redistribution of fluid flow as taught herein.

Although this disclosure refers to specific embodiments, it will be understood by those skilled in the art that various changes in form and detail may be made without departing from the subject matter set forth in the accompanying claims.

We claim:

1. A topper comprising:

a flowpath boundary defining a flowpath adapted to carry a stream of fluid in a principal direction;

a flow compliant filler occupying at least part of the flowpath, the filler comprised of:

a spacer and a set of shape change actuators (SCA's) each comprised of a shape change material (SCM), the properties of the SCM including a critical temperature T0, the SCA's being configured to regulate distribution of the fluid stream through the flowpath as a function of temperature, the regulated distribution of the fluid stream being in a direction transverse to the principal direction so that the mass flow rate of the fluid is nonuniform in the transverse direction.

2. The topper of claim 1 wherein the topper extends longitudinally from a foot end to a head end and laterally from a left side to a right side, the principal direction is longitudinal, and the topper includes a foot segment, a head segment, and a medial segment longitudinally between the foot and head segments, and the filler occupies less than all of the width of the medial segment.

3. The topper of claim 2 wherein the filler occupies only the at least part of the medial segment.

4. The topper of claim 2 wherein the spacer component of the filler is a first spacer having a first operational density, and wherein a second spacer occupies at least one of the head and foot segments, the second spacer having a second operational density which is less than the first operational density.

5. The topper of claim 3 wherein the spacer component of the filler is a first spacer having a first fluid flow resistance, and wherein a second spacer occupies at least one of the head and foot segments, the second spacer having a second fluid flow resistance which is less than the first fluid flow resistance.

6. The topper of claim 2 wherein the medial segment includes a left flank section, a right flank section and a laterally interior section laterally between the left and right flank sections and wherein only the interior section is occupied by the spacer.

7. The topper of claim 1 wherein the SCA's regulate distribution of the fluid stream as a result of at least one of:

a) the composition of the SCA;

b) the shape of the SCA at a temperature TH relative to the shape of the SCA at a temperature TL, where TH>T0 and TL<T0;

c) the orientation of the SCA.

8. The topper of claim 1 wherein the SCA's comprise linear elements oriented vertically.

9. The topper of claim 1 wherein the SCA's comprise linear elements oriented obliquely.

10. The topper of claim 1 wherein the SCA's comprise serpentine elements.

11. The topper of claim 1 wherein the SCA's comprise arch elements.

12. The topper of claim 1 wherein the SCA's comprise coil elements.

13. The topper of claim 1 wherein the SCA's comprise ring elements.

14. The topper of claim 1 wherein the SCA's comprise cantilevered elements.

15. The topper of claim 1 wherein the filler regulates fluid flow substantially as a result of elongation or contraction of the SCA's.

16. The topper of claim 15 wherein the elongation or contraction is a function of a phase change of the SCM as a function of temperature.

17. The topper of claim 1 wherein the filler regulates fluid flow substantially as a result of a change of curvature of the SCA's.

18. The topper of claim 17 wherein the change of curvature is a function of a phase change of the SCM as a function of temperature.

19. The topper of claim 1 wherein at least some of the SCA's comprise a first portion made of a first SCM having a critical temperature of T01 and a second portion made of a second SCM having a critical temperature of T02.

20. The topper of claim 19 wherein T01 is approximately equal to T02.

21. The topper of claim 1 wherein the SCA's comprise a first class of actuators made of a first SCM having a critical temperature of T01 and a second class of actuators made of a second SCM having a critical temperature of T02, the first and second class of actuators being spatially distributed in the flowpath.

22. A topper comprising:

a liner defining an interior volume;

a fluid flow compliant spacer occupying at least part of the interior volume;

a set of shape change actuators (SCA's) each comprised of a shape change material (SCM) material whose properties include a critical temperature T0, such that at a temperature TL, which is lower than T0, the SCA's have a baseline shape and at a temperature TH, which is greater than T0, the actuators take on a shape different from the baseline shape and distend the spacer so that fluid flow resistance of the spacer is decreased in the vicinity of the shape-changed actuators;

wherein the topper has a foot end, a head end longitudinally spaced from the foot end to define a topper length, a left side, and a right side spaced laterally from the left side to define a topper width, and the SCA's are distributed across a first part of the width so that at temperature TH the first plan of the width exhibits less resistance to fluid flow than other part or parts of the width.

23. The topper of claim 22 wherein the first part is a laterally interior section and the other parts are a left flank section and a right flank section.

24. The topper of claim 22 wherein the actuators of the first part are first actuators, and the topper also includes second actuators distributed across the other part or parts, and the second actuators compress the spacer at temperatures below T0.

25. A topper comprising a liner defining an interior space having a principal direction and a transverse direction, the interior space having a resistance to fluid flow in the principal direction, the resistance having a profile in the transverse direction;

an array of shape change elements having a critical temperature T0 and distributed in the interior space to adjust the resistance profile in response to temperature such that the resistance profile is nonuniform in the transverse direction at a temperature TH, which is higher than the critical temperature.

26. The topper of claim 25 wherein the resistance profile is substantially uniform in the transverse direction at a temperature TL, which is lower than the critical temperature.

27. The topper of claim 25 including a spacer residing in the interior space and wherein the resistance is attributable principally to the density of the spacer as affected by response of the shape change elements to temperature.

28. The topper of claim 25 wherein the elements are distributed so that the resistance profile exhibits a lower resistance in response to a higher temperature and a higher resistance in response to a lower temperature.

29. The topper of claim 28 including a spacer residing in the interior space and wherein the resistance is attributable principally to the density of the spacer and wherein the elements respond to the higher temperature by distending the spacer thereby decreasing the density of the spacer.

30. A topper assembly comprising:

A fluid conduit which defines a flowpath for a fluid;

an insulative overlay having a conduit side proximate to the conduit and an occupant side remote from the conduit;

a set of shape change elements each having a critical temperature, the elements being distributed in the insulative overlay such that the shape change elements adjust the heat transfer resistance of the insulative overlay in response to temperature.

31. The topper assembly of claim 30 wherein the elements are distributed such that the heat transfer resistance is lower at a high temperature TH which is higher than the critical temperature and higher at a low temperature TL which is lower than the critical temperature.

32. The topper assembly of claim 30 wherein the elements respond to the higher temperature by compressing the insulative overlay.

33. A topper comprising:

A fluid conduit which defines a flowpath for a fluid;

an insulative overlay atop the conduit, the overlay comprised of a spatially distributed shape change material (SCM) having a thickness and a resistance to heat transfer that increases with increasing thickness, the properties of the SCM including a critical temperature T0, the material being responsive to temperature such that the thickness at a temperature TH, which is higher than the critical temperature, is less than the thickness at a temperature TL, which is lower than the critical temperature.

34. The topper of claim 33 wherein the SCM is present only in one or more zones of the overlay which zones collectively define less than the entire overlay.

35. The topper of claim 33 wherein the overlay comprises:

A) layers of shape change materials in which the layers exhibit different shape changes and/or have different critical temperatures; or B) patches of shape change materials in which the patches exhibit different shape changes and/or have different critical temperatures; or C) both A and B.

* * * * *